US008929758B2

(12) United States Patent
Ramesh et al.

(10) Patent No.: US 8,929,758 B2
(45) **Date of Patent: *Jan. 6, 2015**

(54) METHOD AND APPARATUS FOR COMPENSATION OF BANDING FROM MULTIPLE SOURCES IN MARKING PLATFORM

(71) Applicant: Xerox Corporation, Norwalk, CT (US)

(72) Inventors: Palghat S. Ramesh, Pittsford, NY (US); Peter Paul, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/855,322

(22) Filed: Apr. 2, 2013

(65) Prior Publication Data

US 2013/0216248 A1 Aug. 22, 2013

Related U.S. Application Data

(63) Continuation of application No. 12/966,211, filed on Dec. 13, 2010, now Pat. No. 8,422,899.

(51) Int. Cl.
*G03G 15/00* (2006.01)
*G03G 15/01* (2006.01)

(52) U.S. Cl.
CPC ..... *G03G 15/5058* (2013.01); *G03G 15/0189* (2013.01); *G03G 15/5062* (2013.01)
USPC ..... 399/49; 399/9; 399/72

(58) Field of Classification Search
USPC ..... 399/9, 11, 49, 72; 358/3.26
See application file for complete search history.

(56) References Cited

U.S. PATENT DOCUMENTS

| | | | | |
|---|---|---|---|---|
| 5,519,514 | A | 5/1996 | TeWinkle | |
| 5,550,653 | A | 8/1996 | TeWinkle et al. | |
| 5,680,541 | A | 10/1997 | Kurosu et al. | |
| 6,342,963 | B1 | 1/2002 | Yoshino | |
| 6,462,821 | B1 | 10/2002 | Borton et al. | |
| 6,567,170 | B2 | 5/2003 | Tandon et al. | |
| 6,621,576 | B2 | 9/2003 | Tandon et al. | |
| 6,975,949 | B2 | 12/2005 | Mestha et al. | |
| 7,024,152 | B2 | 4/2006 | Lofthus et al. | |
| 7,058,325 | B2 | 6/2006 | Hamby et al. | |
| 7,120,369 | B2 | 10/2006 | Hamby et al. | |
| 7,136,616 | B2 | 11/2006 | Mandel et al. | |
| 7,177,585 | B2 | 2/2007 | Matsuzaka et al. | |
| 7,823,143 | B2 | 10/2010 | Marwinski | |
| 7,911,652 | B2 | 3/2011 | Goodman et al. | |
| 8,422,899 | B2 * | 4/2013 | Ramesh et al. | 399/49 |
| 2007/0052991 | A1 | 3/2007 | Goodman et al. | |

(Continued)

*Primary Examiner* — Hoang Ngo
(74) *Attorney, Agent, or Firm* — Fay Sharpe LLP

(57) ABSTRACT

A method for compensation of banding in a marking platform includes: initiating a calibration stage; marking a test pattern over multiple intervals of a lowest fundamental frequency among marking modules; obtaining image data for the test pattern from a sensor; obtaining 1× signals from sensors associated with the marking modules; and processing the image data in relation to the 1× signals to form banding profiles for multiple marking modules. Alternatively, the method may include: processing image data in relation to 1× signals to form banding profiles for multiple marking modules; determining amplitudes in multiple banding profiles exceeds a threshold to identify dominant banding profiles; and processing dominant banding profiles to form dominant banding signatures. Alternatively, the method may include: initiating a correction stage; obtaining 1× signals from sensors associated with dominant marking modules; and periodically processing dominant banding signatures and 1× signals to determine a banding compensation value.

21 Claims, 15 Drawing Sheets

(56) References Cited

U.S. PATENT DOCUMENTS

| | | | |
|---|---|---|---|
| 2007/0139509 | A1 | 6/2007 | Mizes et al. |
| 2007/0236747 | A1 | 10/2007 | Paul et al. |
| 2009/0002724 | A1 | 1/2009 | Paul et al. |
| 2011/0058184 | A1 | 3/2011 | Ramesh et al. |
| 2011/0058186 | A1 | 3/2011 | Ramesh et al. |
| 2011/0058226 | A1 | 3/2011 | Ramesh et al. |

* cited by examiner

| FREQ. (Hz) 220 mm/s | SOURCE |
|---|---|
| 1.22 | BLACK PR (USING 188, 1.17 Hz IF USING 60mm DIA.) |
| 1.72 | IBT, DRIVE (59K32500) |
| 1.75 | CMY PR |
| 2.00 | HEAT ROLL |
| 2.24 | FUSER ROLL |
| 2.50 | 2ND BTR |
| 3.50 | 2ND BUR |
| 3.79 | 1ST BTR FOR EACH COLOR |
| 3.89 | IDLE ROLL (59K32510) |
| 5.00 | BCR (K DRUM) |
| 6.11 | DEV ROLLER (MAG ROLL) |

FIG. 4

METHOD AND APPARATUS FOR COMPENSATION OF BANDING FROM MULTIPLE SOURCES IN MARKING PLATFORM

This application is a continuation of co-pending U.S. patent application Ser. No. 12/966,211, filed Dec. 13, 2010, which is fully incorporated herein by reference.

BACKGROUND

The present exemplary embodiment relates generally to compensation of banding from multiple sources in a marking platform. It finds particular application in conjunction with a multicolor marking platform with xerographic marking engines. However, it is to be appreciated that the exemplary embodiments described herein are also amenable to various other types of marking engines and other types of marking platforms.

Banding is a type of image quality defect that occurs on printed pages. It manifests itself as a variation in density with respect to the process direction. Most banding is periodic. Periodic density variations may be characterized by frequency, amplitude, and phase in relation to a fundamental frequency, as well as harmonics. Various sources of banding exist in a marking (or print) engine. The frequencies of these sources are typically known based on the mechanical design of the engine. The frequencies, for example, may be obtained from the manufacturer, third parties, or measured. To compensate for the banding defects, the amplitude and phase also need to be obtained from measurements.

Banding is a major contributor to the color stability of the print engine. For intermediate belt tandem engines, bands and streaks tend to be the number one image quality defect. Sources of banding are typically gears, pinions, and rollers in charging and development modules; jitter and wobble in the imaging modules; and photoreceptors (PRs) and their drive trains. Banding usually manifests itself as periodic density variations in halftones in the process direction. The period of these defects is related to the once around frequency of the banding source.

Recent work has identified techniques for identifying banding sources using measurements of test patterns on paper, using a multipage coherent fast Fourier transform (FFT) technique to identify the banding sources. Further, a cubic spline interpolation technique has been used to fit banding signatures to single known sources, such as PR 1×. The cubic spline interpolation technique has also been applied to derive an optimal exposure correction for single known sources across the tone reproduction curve (TRC) for banding compensation. However, multiple banding sources (e.g., PR, developer roller, bias charge roller (BCR), bias transfer roller (BTR), drive rollers, etc.) are frequently present in many current engines and profiles of these sources may change over time. Currently, no system exists to efficiently compensate for banding from multiple sources.

INCORPORATION BY REFERENCE

The following documents are fully incorporated herein by reference: 1) U.S. Pat. App. Publication No. 2011/0058186 to Ramesh et al. (Ser. No. 12/555,308), filed Sep. 8, 2009, Least Squares Based Coherent Multipage Analysis of Printer Banding for Diagnostics and Compensation; 2) U.S. Pat. App. Publication No. 2011/0058226 to Ramesh et al. (Ser. No. 12/555,275), filed Sep. 8, 2009, Banding Profile Estimation using Spline Interpolation; 3) U.S. Pat. App. Publication No. 2011/0058184 to Ramesh et al. (Ser. No. 12/555,287), filed Sep. 8, 2009, Least Squares Based Exposure Modulation for Banding Compensation; 4) U.S. Pat. App. Publication No. 2007/0052991 to Goodman et al., filed Sep. 8, 2005, Methods and Systems for Determining Banding Compensation Parameters in Printing Systems; 5) U.S. Pat. App. Publication No. 2009/0002724 to Paul et al., filed Jun. 27, 2007, Banding Profile Estimator using Multiple Sampling Intervals; 6) U.S. Pat. App. Publication No. 2007/0139509 to Mizes et al., filed Dec. 21, 2005, Compensation of MPA Polygon Once Around with Exposure Modulation; 7) U.S. Pat. App. Publication No. 2007/0236747 to Paul et al., filed Apr. 6, 2006, Systems and Methods to Measure Banding Print Defects; 8) U.S. Pat. No. 7,120,369 to Hamby et al., filed May 25, 2004, Method and Apparatus for Correcting Non-uniform Banding and Residual Toner Density using Feedback Control; 9) U.S. Pat. No. 7,058,325 to Hamby et al., filed May 25, 2004, Systems and Methods for Correcting Banding Defects using Feedback Control and/or Feedforward Control; 10) U.S. Pat. No. 5,519,514 to TeWinkle; 11) U.S. Pat. No. 5,550,653 to TeWinkle et al.; 12) U.S. Pat. No. 5,680,541 to Kurosu et al.; 13) U.S. Pat. No. 6,621,576 to Tandon et al.; 14) U.S. Pat. No. 6,342,963 to Yoshino; 15) U.S. Pat. No. 6,462,821 to Borton et al.; 16) U.S. Pat. No. 6,567,170 to Tandon et al.; 17) U.S. Pat. No. 6,975,949 to Mestha et al.; 18) U.S. Pat. No. 7,024,152 to Lofthus et al.; 19) U.S. Pat. No. 7,136,616 to Mandel et al.; and 20) U.S. Pat. No. 7,177,585 to Matsuzaka et al.

BRIEF DESCRIPTION

In one aspect, a method for compensation of banding in a marking platform is provided. In one embodiment, the method includes: a) initiating a calibration stage to determine banding characteristics of a marking platform, the marking platform comprising a plurality of marking modules at least a portion of which are select marking modules, wherein each select marking module is provisioned with at least one once around sensor and each once around sensor is adapted to provide a 1× signal indicative of a fundamental frequency for banding characteristics associated with the corresponding select marking module; b) marking a banding test pattern on an image receiving member over at least multiple intervals of a lowest fundamental frequency among the select marking modules; c) obtaining banding image data for the banding test pattern from a test pattern image sensor in conjunction with the marking in b); d) obtaining 1× signals from each once around sensor in conjunction with the marking in b); and e) processing the banding image data in relation to the 1× signals to form a banding profile for each of two or more select marking modules, wherein the fundamental frequency associated with each 1× signal is used to determine banding characteristics attributed to the corresponding select marking module and filter banding characteristics not attributed to the corresponding select marking module for the corresponding banding profile, each banding profile reflecting a phase relation of amplitude banding characteristics to the corresponding fundamental frequency in relation to the banding test pattern.

In yet another embodiment, a method for compensation of banding in a marking platform includes: a) initiating a correction stage for banding compensation of a marking platform in conjunction with processing a marking job, the marking platform comprising a plurality of marking modules at least a portion of which are select marking modules, each select marking module provided with at least one once around sensor, wherein each once around sensor is adapted to provide a 1× signal indicative of a fundamental frequency for banding characteristics associated with the corresponding select marking module; b) obtaining 1× signals from at least each once around sensor associated with dominant marking modules of the marking platform in conjunction with processing the marking job, the dominant marking modules identified as select marking modules in which at least one amplitude value in a banding profile for the corresponding select marking module exceeds a corresponding amplitude threshold; and c) periodically processing dominant banding signatures and the corresponding 1× signals obtained in b) to determine a current banding compensation value for the marking platform in conjunction with processing the marking job, each dominant banding signature formed by processing the corresponding dominant banding profile for the corresponding dominant marking module, each dominant banding signature reflecting the phase relation of amplitude and frequency banding characteristics over at least one sample period of the corresponding fundamental frequency for the corresponding dominant marking module, wherein the reference frequencies for the 1× signals obtained in b) are used to combine the corresponding dominant banding signatures in elapsed time relation to a start time for processing the marking job to determine the current banding compensation value.

In another aspect, an apparatus for compensation of banding in a marking platform is provided. In one embodiment, the apparatus includes: a digital signal processing module for processing calibration banding image data in relation to 1× signals to form a banding profile for each of two or more select marking modules within a marking platform, the marking platform comprising a plurality of marking modules at least a portion of which are select marking modules, each select marking module provided with at least one once around sensor, wherein each once around sensor is adapted to provide a 1× signal indicative of a fundamental frequency for banding characteristics associated with the corresponding select marking module, wherein the calibration banding image data is obtained from a test pattern image sensor and representative of a banding test pattern marked on an image receiving member over at least multiple intervals of a lowest fundamental frequency among the select marking modules; wherein the digital signal processing module is adapted to determine at least one amplitude value in two or more banding profiles exceed a corresponding amplitude threshold to identify dominant banding profiles and corresponding dominant marking modules; wherein the digital signal processing module is adapted to process each dominant banding profile to form a dominant banding signature for the corresponding dominant marking module, each dominant banding signature reflecting the phase relation of amplitude and frequency banding characteristics over at least one sample period of the corresponding fundamental frequency for the corresponding dominant marking module.

BRIEF DESCRIPTION OF THE DRAWINGS

FIG. 1 is a block diagram of an exemplary embodiment of a marking platform;

FIG. 4 is a table showing potential banding sources in an exemplary marking platform;

DETAILED DESCRIPTION

Figure 7:
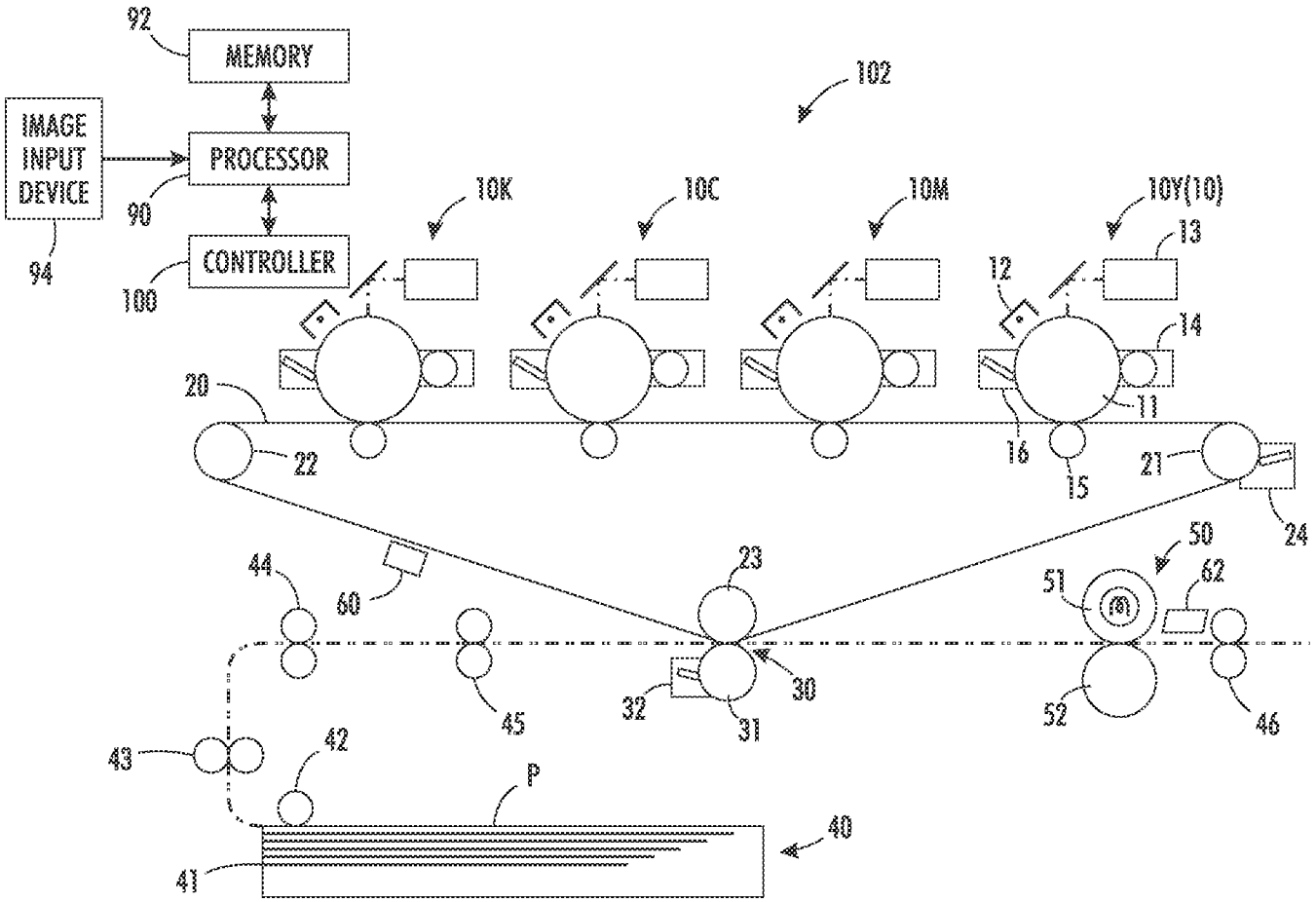
FIG. 7 is a graph showing a banding signature for a banding source in an exemplary marking platform. The banding source having a fundamental frequency of 2.5 Hz.

This disclosure describes various embodiments of methods and systems for compensation of banding from multiple sources. The system includes a set of low cost once around (1×) sensors installed on multiple banding sources in the printer (e.g. PR, developer roller, BTR, fuser roller, drive roller shafts, etc.). The 1× sensors provide fundamental frequency characteristics for corresponding individual sources may be used as a reference to determine phase characteristics for banding attributed to the corresponding source. Additionally, a page synchronization signal may be captured to obtain page timing information. A set of test pages may be printed during a calibration stage and used to construct a multipage coherent FFT using the page timing information. The page signatures used to construct the coherent FFT may be obtained either using an on-belt density sensor (e.g., enhanced tone area coverage (ETAC) sensor, area density coverage (ADC) sensor, full width array (FWA) sensor), an on-paper sensor (e.g., inline spectral (ILS) sensor), or with off line measurements of the prints on a scanner. The coherent multipage FFT analyses may be used to identify dominant banding sources. For additional information on the coherent multipage FFT analyses, see U.S. Pat. App. Publication No. 2011/0058186 to Ramesh et al. (Ser. No. 12/555,308), filed Sep. 8, 2009, Least Squares Based Coherent Multipage Analysis of Printer Banding for Diagnostics and Compensation.

The 1× sensor data of the corresponding banding sources may be used to obtain the phase reference. A multisource exposure correction signal for each color separation may be derived to compensate for banding in the corresponding color separation. The multisource exposure correction signal may be applied during normal printing. The banding calibration procedure may be repeated periodically to account for profile drift and banding from new sources due to changes in environment, components aging, etc. Previous banding compensation techniques have focused on single and fixed sources of banding. The exemplary embodiments of methods and systems disclosed herein extend those concepts to include multiple and variable banding sources.

Banding profile analyses usually involves printing several pages of a uniform halftone image and measuring the prints using an offline or inline spectrophotometer, scanner, or density sensor. The image data may be averaged in the cross process direction to obtain one-dimensional (1D) signatures in the process direction which are then analyzed for banding. One technique for banding source identification is called "Coherent Multipage Analysis." This technique combines image data across multiple pages using timing data for each page into a coherent signal. The coherent signal is analyzed using Least Squares Estimation for both periodic and aperiodic components. The periodic components of the signal give the banding spectra. The peaks of the spectra can be used to identify the major banding sources. For additional information on "Coherent Multipage Analsys," see U.S. Pat. App. Publication No. 2011/0058186 to Ramesh et al. (Ser. No. 12/555,308), filed Sep. 8, 2009, Least Squares Based Coherent Multipage Analysis of Printer Banding for Diagnostics and Compensation.

The "banding profile," "banding signature," "banding compensation value," and "banding correction value" are terms and phrases used to describe the various embodiments of the methods and systems for compensation of banding from multiple sources. As used herein, "banding profile" can include a raw sensed density variation as a function of process direction position over multiple pages. As used herein, "banding signature" can include unraveled profiles reduced to the average density variation in the process direction for one period. As used herein, "banding compensation value" can include a sum of instantaneous banding signatures at appropriate respective phases based on a current elapsed time. As used herein, "banding correction value" can include a banding compensation value scaled by a sensitivity constant to adjust the banding compensation value to correspond to a drive signal of an actuator unit for a particular marking module capable of compensating for banding.

Turning now to the drawings, FIG. 1 illustrates a schematic perspective view of an exemplary embodiment of a marking platform 102 in accordance with an embodiment. The marking platform 102 includes plural (in this exemplary embodiment, four) marking engines 10, an intermediate transfer belt 20, a secondary transfer device 30, a sheet carrying device 40, and a fixing device 50. The marking platform 102 further includes a controller 100, a processor 90, a memory 92, and an image input device 94. The controller 100 may be provided to control the various elements and sequence of operations of the marking platform 102. In some implementations, the controller 100 and/or processor 90 may be dedicated hardware like ASICs or FPGAs, software (firmware), or a combination of dedicated hardware and software. For the different applications of the embodiments disclosed herein, the programming and/or configuration may vary. The processor 90 may include one processor or one or more sub-processors. The exemplary marking platform 102 shows a xerographic color image printing system with an "intermediate-belt-transfer" in which successive primary-color (e.g., C, M, Y, K) images are accumulated on image bearing surfaces 11 of a PR drum. Each image bearing surface 11 in turn transfers the images to an intermediate transfer member 30. However, it should be appreciated that any image printing machine, such as monochrome machines using any technology, machines that print on photosensitive substrates, xerographic machines with multiple PRs, "image-on-image" xerographic color image printing systems (e.g., see U.S. Pat. No. 7,177,585), tightly integrated parallel printing (TIPP) systems (e.g., see U.S. Pat. Nos. 7,024,152 and 7,136,616), or ink-jet-based machines may utilize the exemplary embodiments provided in this disclosure as well.

The marking engine 10 includes a yellow unit 10Y for forming a yellow image, a magenta unit 10M for forming a magenta image, a cyan unit 10C for forming a cyan image, and a black unit 10K for forming a black image. The yellow unit 10Y, the magenta unit 10M, the cyan unit 10C and the black unit 10K form toner images of respective color separations as images, for example, via electrophotography techniques.

The marking engines 10Y, 10M, 10C and 10K, which may serve as an image forming section, have the same configuration except different colors of toner are used. Accordingly, for example, the yellow unit 10Y will be described below. The yellow unit 10Y includes an image bearing surface 11, a charging device 12, an exposure device 13, a developing device 14, a primary transfer device 15 and a drum cleaner 16. The charging device 12 charges the image bearing surface 11 to a predetermined potential. The exposure device 13 exposes the charged image bearing surface 11 to form an electrostatic latent image. The developing device 14 receives each color component toner (in the yellow unit 10Y, yellow toner) and develops the electrostatic latent image formed on the image bearing surface 11 with the toner. The primary transfer device 15, for example, includes a roll member (e.g., primary transfer roll) which is in pressure-contact with the image bearing surface 11 via the intermediate transfer belt 20 with the intermediate transfer belt interposed between the primary transfer device 15 (roll member) and the image bearing surface 11. The primary transfer device 15 applies a predetermined transfer bias between the image bearing surface 11 and the primary transfer roll to primarily transfer the toner image formed on the image bearing surface 11 onto the intermediate transfer belt 20. The drum cleaner 16 removes remaining toner on the image bearing surface 11 after the primary transfer.

The intermediate transfer belt 20, which serves as a recording material, may be disposed rotatably and wound on a driving roll 21, a driven roll 22 and a backup roll 23. Among them, the driving roll 21 may be rotatable, and may stretch the intermediate transfer belt 20 and transmit a driving force to the intermediate transfer belt 20. The driven roll 22 may be rotatable, and may stretch the intermediate transfer belt 20 and merely rotates as the intermediate transfer belt 20 rotates. The backup roll 23 may be rotatable, and may stretch the intermediate transfer belt 20 and may serve as a constituent component of the secondary transfer device 30 as described below. A belt cleaner 24 for removing the remaining toner on the intermediate transfer belt 20 after secondary transfer may be provided so as to face a part of the intermediate transfer belt 20 wound on the driving roll 21.

The secondary transfer device 30 includes a secondary transfer roll 31 that is rotatable and that is in pressure-contact with a surface, on a side where the toner image is carried, of the intermediate transfer belt 20. The secondary transfer device 30 also includes the backup roll 23 disposed on the rear surface of the intermediate transfer belt 20 to form an opposite electrode for the secondary transfer roll 31. A predetermined secondary transfer bias is applied between the secondary transfer roll 31 and the backup roll 23 such that the toner image on the intermediate transfer belt 20 is secondarily transferred onto a sheet of target media P (e.g., paper). For example, a roll cleaner 32 for removing the toner transferred from the intermediate transfer belt 20 to the secondary transfer roll 31 is mounted on the secondary transfer roll 31.

Marking platform 102 may include sensors 60 and 62 individually or in combination. Sensors 60 and 62 are configured to provide image data (e.g., reflectance of the image in the process and/or cross-process direction) to the processor 90. The sensor 60 may be configured to sense images created on the intermediate transfer belt 20 and/or to scan test patterns. Sensor 62 may be configured to sense images created in output prints on target media P, including paper prints. It should be appreciated that any number of sensors may be provided, and may be placed anywhere in the marking platform 102 as needed, not just in the locations illustrated.

It should be appreciated that sensors 60 and 62 may be ADC sensors. See, e.g., U.S. Pat. No. 5,680,541 for example of an ADC sensor. Alternatively, sensors 60 and 62 may be FWAs or ETAC sensors. See, e.g., U.S. Pat. Nos. 6,975,949 and 6,462,821, for examples of a FWA and an ETAC sensor, respectively. Sensors 60 and 62 may alternatively include a spectrophotometer, color sensors, or color sensing systems. See, e.g., U.S. Pat. Nos. 6,567,170; 6,621,576; 5,519,514; and 5,550,653 for examples of these types of sensors. It should be appreciated that other linear array sensors may also be used, such as contact image sensors, CMOS array sensors or CCD array sensors.

Image input device 94 (e.g., an input scanner) may capture an image from an original document, a computer, a network, or any similar or equivalent image input terminal. Where the image input device 94 includes a scanner, it may be used in the same manner as sensor 62 to sense images on target media, including test patterns for assessment of banding characteristics. In this exemplary embodiment, image input device 94 may send image data to processor 90.

Processor 90 is configured to receive reflectance of the image, or image data, in the process and/or cross-process direction sensed by sensors 60 and/or 62. The processor 90 is configured to generate reflectance signature data and send the data to the controller 100. Processor 90 may also be configured to augment image data with timing data from a signal that is synchronous with the banding source such as a 1× sensor. See, e.g., U.S. Pat. App. Publication No. 2007/0236747 for an example of use of a 1× sensor. Data received and generated by processor 90 may be stored on memory 92.

The sheet carrying device 40 includes a sheet accommodating section 41, a pickup roll 42, a separation roll 43, a preregistration roll 44, a registration roll 45 and an ejection roll 46. The sheet accommodating section 41 has an opening at its upper part, has a rectangular shape and accommodates the sheet P therein. The pickup roll 42 is provided above the sheet accommodating section 41 to continuously feed an uppermost target media P of the stack of target media P accommodated in the sheet accommodating section 41. The separation roll 43 separates and carries the target media P, which are continuously fed by the pickup roll 42, one by one. The preregistration roll 44 carries the target media P carried through the separation roll 43 downstream and forms a loop together with the registration roll 45. The registration roll 45 pauses the carrying of the target media P and resumes the rotation at a predetermined timing so as to feed the target media P while control the registration with respect to the secondary transfer device 30. The ejection roll 46 carries the target media P, on which the toner image is transferred by passing through the secondary transfer device 30 and is fused by passing through the fixing device 50, toward a not-shown ejection section.

The fixing device 50 includes a heating roil 51 which has a heating source therein and which is rotatable. The fixing device 50 also includes a pressing roll 52 which is in contact with the heating roll 51 and rotates as the heating roll 51 rotates.

In one embodiment, processor 90 may be configured to obtain timing information and combine timing information with image data. For example, while printing, the page timing information may be obtained, such as page synchronization signals and banding source timing information (e.g., 1× signals). The page synchronization signal may be a signal internally generated by controller 100 (shown in FIG. 1), for example, as is well known in the art. See U.S. Pat. No. 6,342,963, FIGS. 13A and 13B and corresponding discussion for examples of page synchronization signals. The page synchronization signal may indicate the leading and trailing edges of a page of an output image. The 1× signals may indicate the beginning and end of a corresponding banding source (e.g., PR) cycle, wherein a cycle begins and ends at the same point on the banding source. The 1× signal may be generated by an optical sensor or encoder mounted on the rotating shaft associated with the banding source. For additional information on obtaining timing information and combining timing information with image data, see, e.g., U.S. Pat. App. Publication Nos. 2009/0002724 and 2007/0236747.

Figure 2:
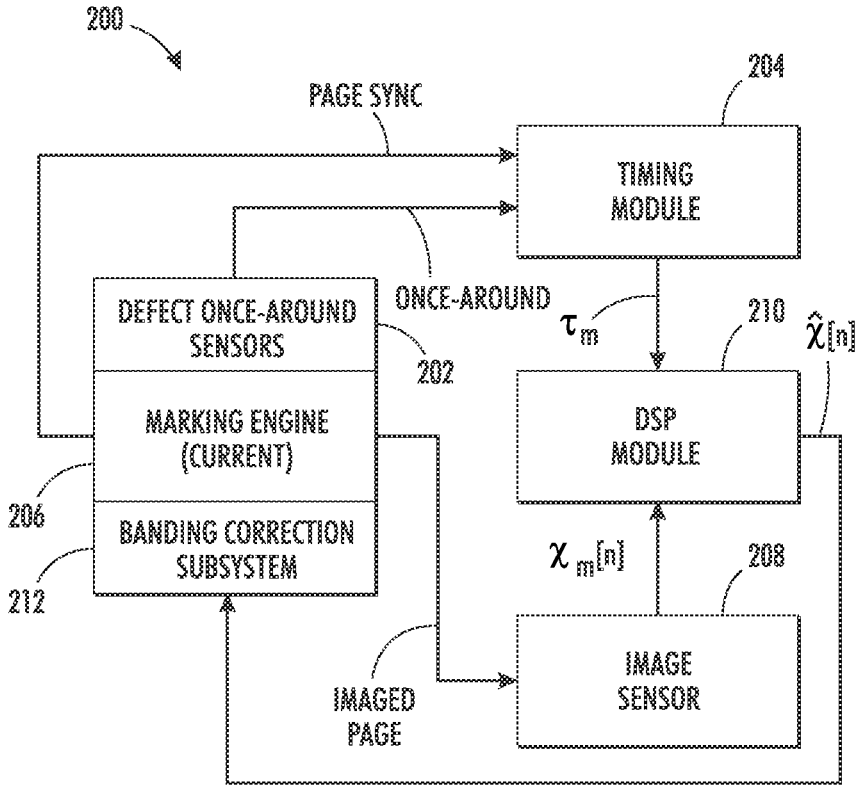
FIG. 2 is a block diagram of another exemplary embodiment of a marking platform.

With reference to FIG. 2, another exemplary embodiment of a marking platform 200 includes one or more 1× sensors 202 for multiple banding sources (i.e., marking modules) for which banding defects are is to be corrected. These are discrete 1× sensors 202 generate a pulse when the once-around associated with the corresponding banding source occurs.

The 1× sensors 202 send a 1× signal to a timing module 204 which also may also receive a page synchronization signal from a marking engine 206 for calculating $t_{1x\text{-}PS}$ and the page-sync-to-page-sync delays $t_{PS\text{-}PS,m}$. The timing module 204, for example, may include programmable logic chips that count clock cycles between the page sync and 1× signals. The timing module 204 may also include a primitive arithmetic logic unit to obtain the value of $T_0$, in addition to those $T_m$ for $m=\{1, 2, \ldots, M-1\}$, which are directly measured.

The marking platform 200 further includes an image sensing module 208. One embodiment calls for an offline scanner manned by a printer technician or customer who would be asked to calibrate the printer periodically to update banding estimates. Another, more automated, embodiment calls for an in-situ sensor or sensing array. This could also be a point density sensor (e.g., ETAC) or an external scanner. This scanning module may produce the M N-point print signatures $x_{m[n]}$.

The outputs of the timing and image sensing (or scanning) modules 204, 208 are forwarded to a processing module 210 which may calculate a banding signature estimate. The processing module 210 may include a microprocessor and memory to calculate various equations (e.g., matched-filter based algorithm).

The banding signature estimate x[n] produced by the processing module 210 may be provided to a banding correction module 212 which is in operative communication with one or more on marking modules of the marking engine 206. The banding correction module may use the estimated banding signature to compensate for banding defect from various banding sources in marking engine 206. The marking platform 200, for example, may comprise one or more of the following: electrophotographic printer, an aqueous ink jet printer, a solid ink jet printer, a monochrome printer, a color printer, a high fidelity color printer, and a highlight printer.

Banding correction requires estimation of a banding signature for a banding source. The banding signature is used to determine a banding compensation signal that applies an adjustment (i.e., correction) to a drive signal to an adjustable marking module, such as exposure modulation to an imaging and exposure module. Current methods for banding compensation are focused on single source banding such as photoreceptor once around (PR 1×). FFTs (single page or coherent multipage) are used to obtain the banding signature and the signal from a 1× sensor is used to obtain the phase relationship to the source. Recently, a spline interpolation method has been proposed for accurate and efficient determination of the banding signature and weighted least squares estimation technique has been proposed to determine optimal banding compensation across the TRC. For additional information on the spline interpolation method, see U.S. Pat. App. Publication No. 2011/0058226 to Ramesh et al. (Ser. No. 12/555,275), filed Sep. 8, 2009, Banding Profile Estimation using Spline Interpolation. For additional information on the weighted least squares estimation technique, see U.S. Pat. App. Publication No. 2011/0058184 to Ramesh et al. (Ser. No. 12/555,287), filed Sep. 8, 2009, Least Squares Based Exposure Modulation for Banding Compensation.

Figure 3:
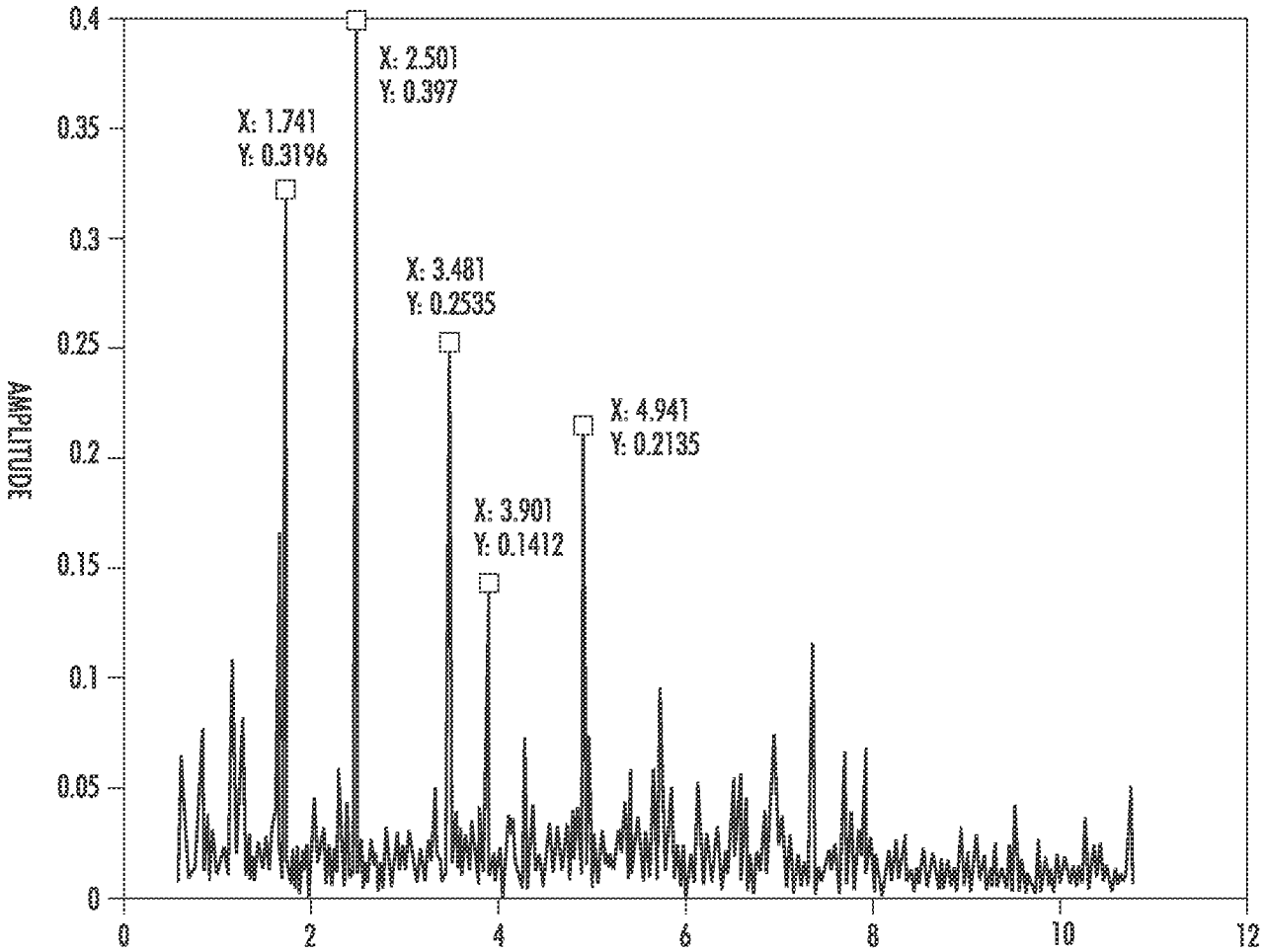
FIG. 3 is a graph showing a multipage coherent FFT of 50% cyan halftone from an exemplary marking platform.

Banding due to multiple sources may be observed. For example, FIG. 3 shows a multipage coherent FFT of 50% cyan halftone data from a xerographic marking platform. FIG. 4 shows a table of potential known banding sources and associated frequencies. As shown by FIGS. 3 and 4, most of the dominant peaks can be associated with known banding sources and their harmonics. Also, in this example of a xerographic marking platform, there are at least two dominant banding sources: 1) photoreceptor 1× (1.74 Hz) and 2) second BTR (2.5 Hz). Of course, dominant banding sources can change over time as components age, such as changes to the PR 1× due to photoreceptor wear, changes to developer roller 1× due to developer roller surface wear, or changes due to a temporary disturbance in the marking platform such as light shock to the PR drum. Thus, any banding compensation strategy based on single source or fixed sources would likely be unsatisfactory over the life of the machine.

As shown in FIG. 3, frequency spectra of L* variation on the data shows peaks that can be related to the known banding sources (see FIG. 4) this xerographic marking platform. For example, 1.74 Hz for cyan PR 1×, 2.5 Hz for a second BTR, 3.48 Hz for a first harmonic of the cyan PR 1×, 3.9 Hz for an idle roller, and 4.94 Hz for a black BCR.

Figure 5:
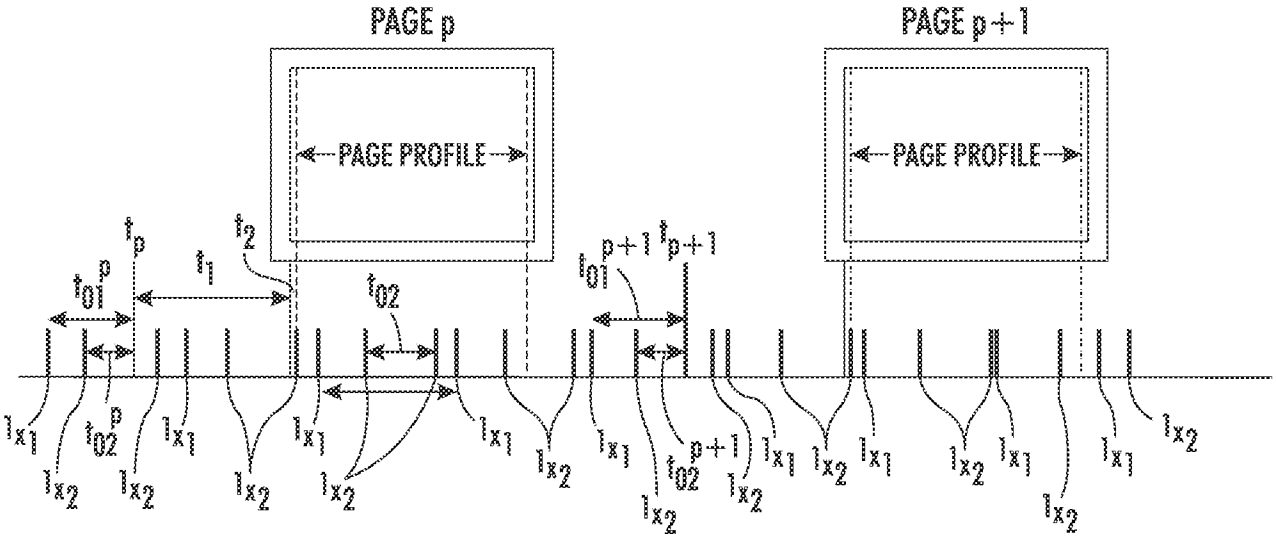
FIG. 5 is a timing diagram for analyzing banding characteristics of multiple banding sources in an exemplary marking platform in relation to multiple target media page images.

In various embodiments of methods and systems disclosed herein, the marking platform (e.g., printer) is instrumented with low cost 1× sensors on certain potential banding sources determined during product development. In addition, a page synchronization signal is captured to construct the coherent multipage FFT. FIG. 5 shows a timing schematic for banding signature estimation for multiple banding sources. The $t_p$ and $t_{p+1}$ lines are the page synchronization signals. The $1_{x1}$ lines and the $1_{x2}$ lines are the 1× signals from banding sources with frequencies $1/T_{01}$ and $1/T_{02}$. The page signature is measured between the dashed lines on each target media page. For example, FIG. 5 shows two banding sources. $t_p$ is the page synchronization time for page p. $t_1$ is the time between the page synchronization and the start of an image on the page. $t_2$ is the time between start of image on a page and start of measured signature on the page. Both $t_1$ and $t_2$ are fixed for a particular target image. $t_{0j}^p$ is the time between the page synchronization for page p and the most recent once around signal for source j. $T_{0j}$ is the once around period of the banding source j and the banding source frequency is $f_{0j}=1/T_{0j}$.

Consider a point q in the page signature for page p, located at a distance $x_q$ from the beginning of the signature. The time at q from the beginning of the page signature is $t_q=x_q/v$, where v is the process speed. The banding source j once around time at location q on page p is given by $t_{pq}^j=\mathrm{Mod}(t_{0j}^p+t_1+t_2+t_q, T_{0j})$. Let y(p,q) represent the color parameter value (e.g., L*, deltaE, scanner grayscale value, or reflectance) at location q on page p as measured by an offline or in line sensor (e.g., spectrophotometer, scanner, or density sensor).

One model to consider is $\hat{y}(p,q)=g_1(p)+g_2(q)+g_3(p,q)$, where $g_1(p)$ refers to the page to page drift, $g_2(q)$ refers to the lead edge to trail edge variation, and $g_3(p,q)$ refers to the variation due to the banding sources. For additional information on this model, see, e.g., U.S. Pat. App. Publication No. 2011/0058186 to Ramesh et al. (Ser. No. 12/555,308), filed Sep. 8, 2009, Least Squares Based Coherent Multipage Analysis of Printer Banding for Diagnostics and Compensation and U.S. Pat. App. Publication No. 2011/0058226 to Ramesh et al. (Ser. No. 12/555,275), filed Sep. 8, 2009, Banding Profile Estimation using Spline Interpolation for additional information on the model.

It is assumed that $g_1$ and $g_2$ can be expressed as polynomials:

$$g_1(p)=\sum_{i=0}^{n_1} a_i t_p^i \text{ and } g_2(q)=\sum_{i=1}^{n_2} b_i t_q^i.$$

$n_1$ and $n_2$ are the order of the polynomial for $g_1$ and $g_2$, respectively. The periodic component $g_3$ can be expressed as $$g_3(p,q)=\sum_{j=1}^{N_s}\sum_{i=1}^{n_h}(c_{ji}\mathrm{Cos}(2\pi i f_{0j} t_{pq}^j)+d_{ji}\mathrm{Sin}(2\pi i f_{0j} t_{pq}^j)).$$

$N_s$ is the number of banding sources, and $n_h$ is number of harmonics of the banding source frequency. The coefficients $a_i$, $b_i$, $c_{ji}$ and $d_{ji}$ may be solved using Least Squares Estimation:

$$\mathrm{Min}\left[\sum_{p=1}^{P}\sum_{q=1}^{Q}(y(p,q)-\hat{y}(p,q))^2\right], \qquad \text{Equation (1)}$$

where P is the number of pages and Q is the number of samples per page. The banding signature for source j is then given by:

$$b_j(t)=\sum_{i=1}^{n_b} A_{ji}\mathrm{Cos}(2\pi i f_{0j} t_j+\phi_{ji}),$$

where the amplitude $A_{ji}$ and phase $\Phi_{ji}$ are given by:

$$A_{ji} = \sqrt{c_{ji}^2 + d_{ji}^2},\ \phi_{ji} = \arctan\left(-\frac{d_{ji}}{c_{ji}}\right).$$

$t_j$ is the 1× time for source j. The dominant sources can be identified by comparing the amplitudes (peak to peak of the banding signatures for each potential source) to a predetermined threshold ($A_{min}$). The threshold may be frequency dependent. In other words, the thresholds may be adjusted depending on whether the amplitude of interest is for a particular fundamental frequency or a particular harmonic frequency. The correction stage may be directed to dominant sources to which the majority of banding defects are attributed.

Alternatively, the periodic banding signatures can also be expressed using piecewise splines (e.g. cubic). In this embodiment, let $y_1(p,q)=y(p,q)-g_1(p)-g_2(q)$ where $g_1$ and $g_2$ are obtained as above. Consider $n_k$ spline knots located at $t_s^k(j)=(k-1)T_{0j}/n_k$ for k=1 . . . $n_k$ for source j. The periodic component is given by $$g_3(p, q) = \sum_{j=1}^{N_s} S_{kj}(t_{pq}^j) \text{ for } t_s^k(j) \le t_{pq}^j \le t_s^{k+1}(j)$$

where $S_{kj}$ defines a spline between $t_s^k(j)$ and $t_s^{k+1}(j)$. A standard spline smoothing algorithm is used to obtain $S_{jk}$ that best fits $y_1(p,q)$. For additional information on using piecewise splines, see U.S. Pat. App. Publication No. 2011/0058226 to Ramesh et al. (Ser. No. 12/555,275), filed Sep. 8, 2009, Banding Profile Estimation using Spline Interpolation.

Figure 6:
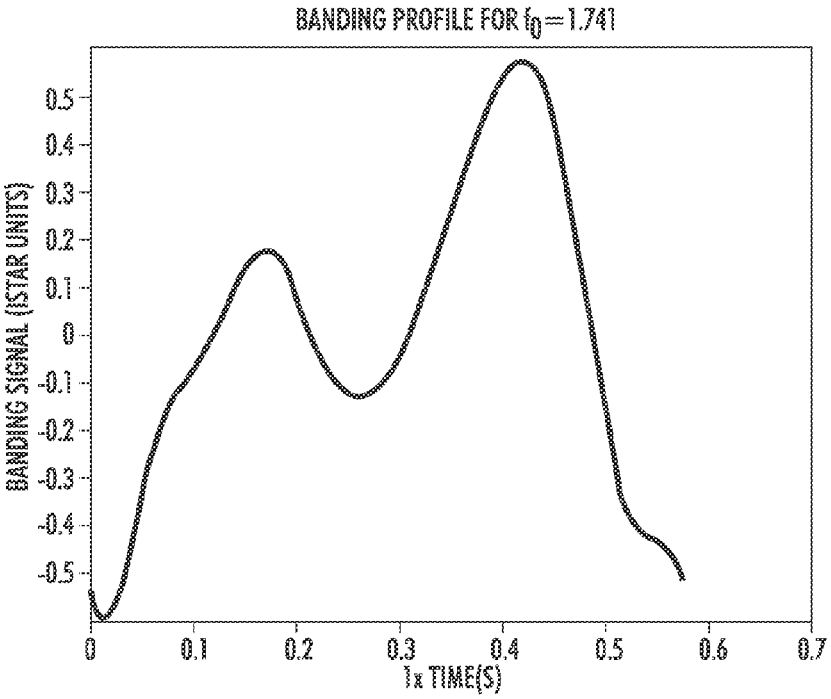
FIG. 6 is a graph showing a banding signature for a banding source in an exemplary marking platform. The banding source having a fundamental frequency of 1.74 Hz.
Figure 7:
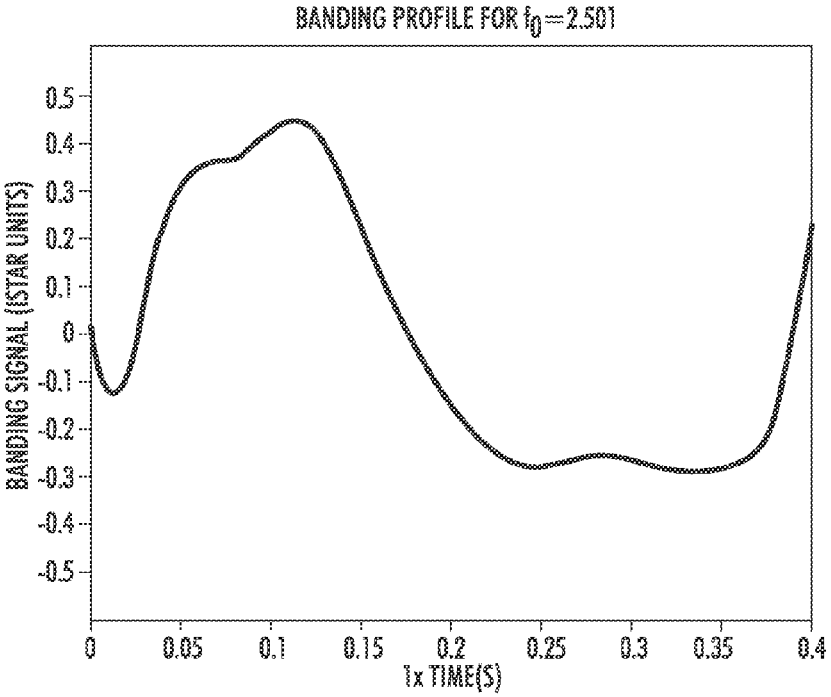

FIGS. 6 and 7 show fitted banding signatures processed using a cubic spline interpolation for banding sources having fundamental frequencies of 1.74 Hz and 2.5 Hz, respectively, in relation to the frequency spectra of FIG. 3. This demonstrates that there are different banding periods (x-axis) for different banding sources. FIG. 6 also the presence of harmonic frequencies relating to the fundamental frequency.

Figure 8:
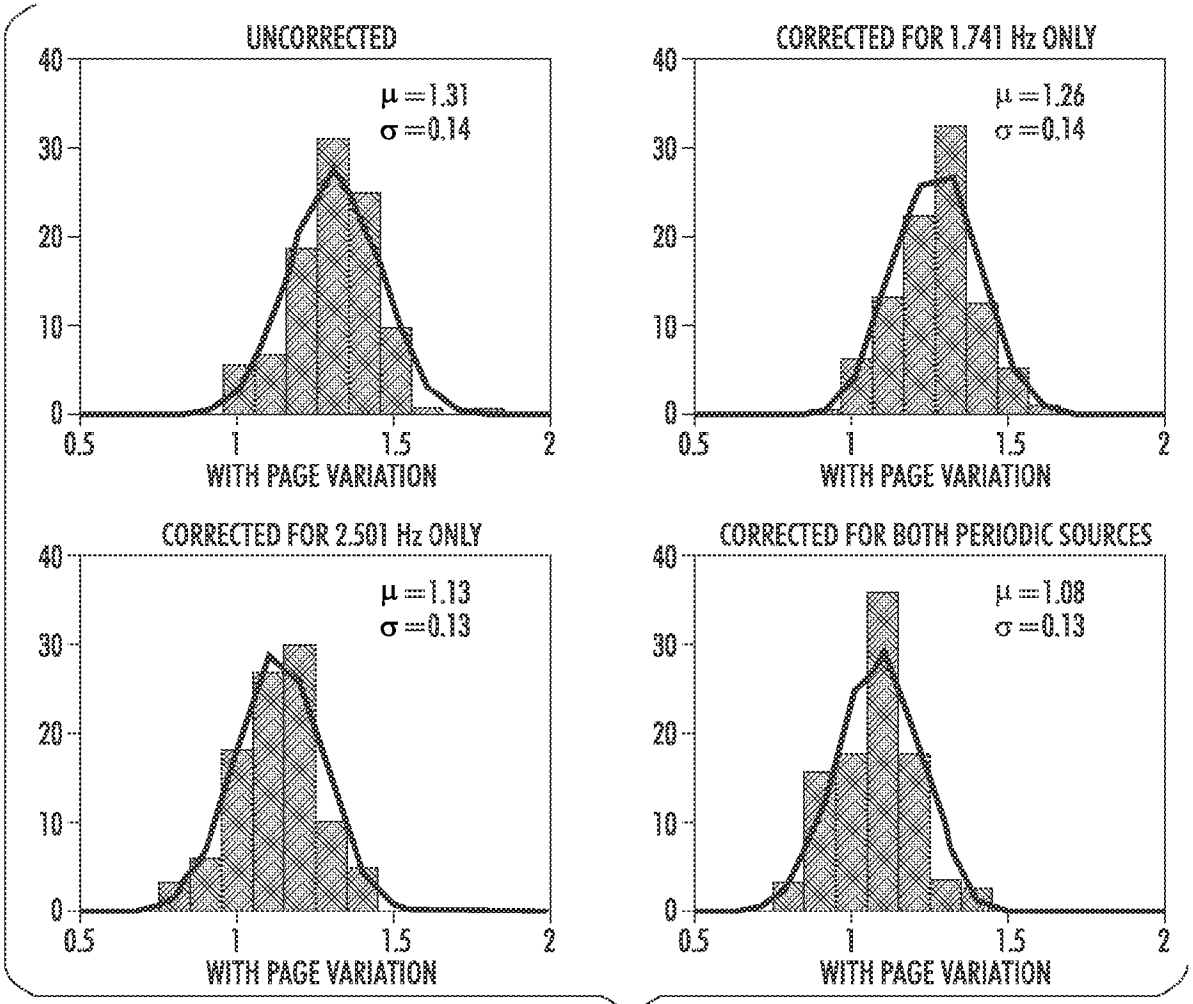
FIG. 8 provides graphs showing simulated improvement in within page uniformity with banding correction for multiple banding sources in an exemplary marking platform.

FIG. 8 shows simulated improvements with correction of banding from single sources and correction of banding from multiple sources for the conditions depicted in FIGS. 3, 6, and 7. As shown, the "within page" uniformity in a 100 page job is plotted for the uncorrected, corrected for single source banding, and corrected for multisource banding. Not surprisingly, the multisource banding correction yields better results than signal source banding correction. The improvement in multisource banding correction may depend on the magnitude of banding of the individual sources.

The multisource banding correction method described herein can also be used to correct for aperiodic variations, such as "within page" lead-edge to trail edge variations. For example, the page synchronization signal may be used as the reference signal for correction of this type of aperiodic variation.

Figure 9:
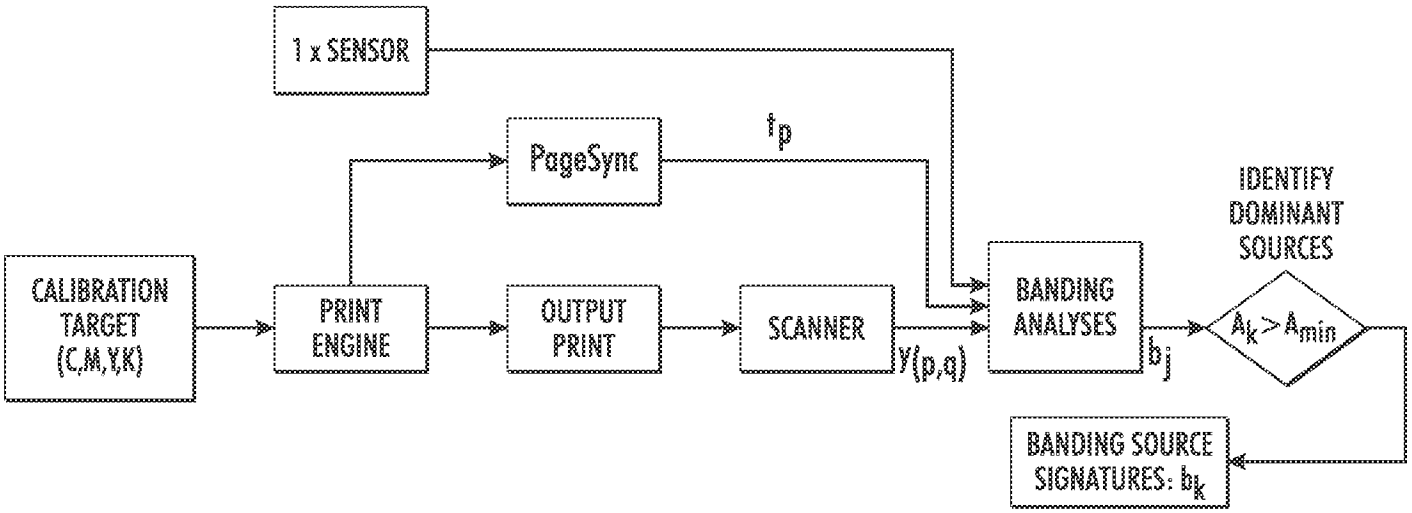
FIG. 9 is a block diagram of an exemplary embodiment of a calibration stage of a banding compensation system for compensation of banding from multiple sources in an exemplary marking platform.
Figure 10:
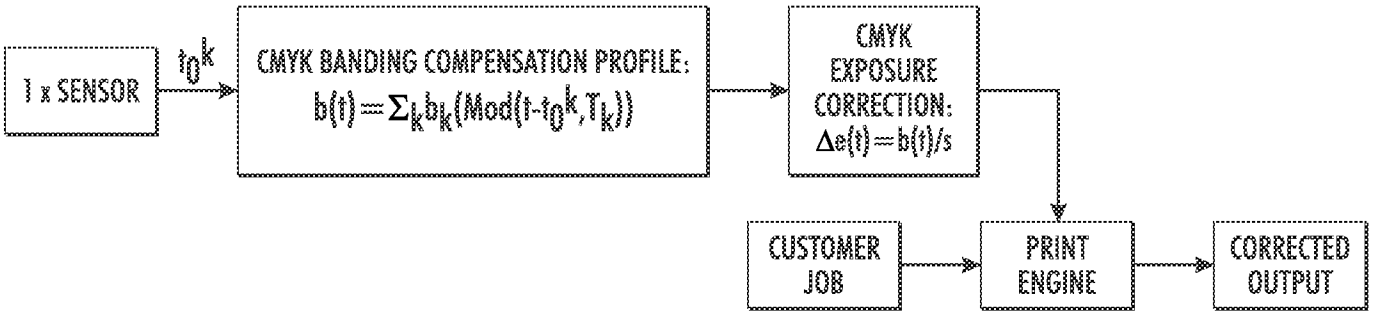
FIG. 10 is a block diagram of an exemplary embodiment of a correction stage of a banding compensation system for compensation of banding from multiple sources in an exemplary marking platform.

FIGS. 9 and 10 show exemplary embodiments of calibration and correction stages for compensation of banding from multiple sources in a multisource banding correction system. With reference to FIG. 9, during the calibration stage, CMYK test targets are printed and analyzed to identify the dominant sources and the associated banding signatures of these sources. The test targets may be printed for any individual color separation, any combination of color separations, or all color separation. The scanner measures signatures in process direction. The scanner can be an off line scanner or density (ADC) sensors, a FWA or an ILS for inline sensing.

With reference to FIG. 10, during the correction stage, the CMYK exposure correction signal may be obtained from the banding signatures for multiple banding sources obtained from the calibration stage and the phase reference signals obtained from the 1× sensors. The calibration stage can be run periodically to track both changes in banding profiles, as well as addition/removal of banding sources. Since the same actuator is used to compensate for the banding sources, it is noted that the frequency of the banding sources do not significantly excite the dynamics of the actuator. In other words, the same actuator sensitivity value can be used for all banding sources. While the individual $b_k$ may be stored in a table, the aggregate b(t) is calculated in real time due to long aggregate periods for multiple sources.

Figure 11:
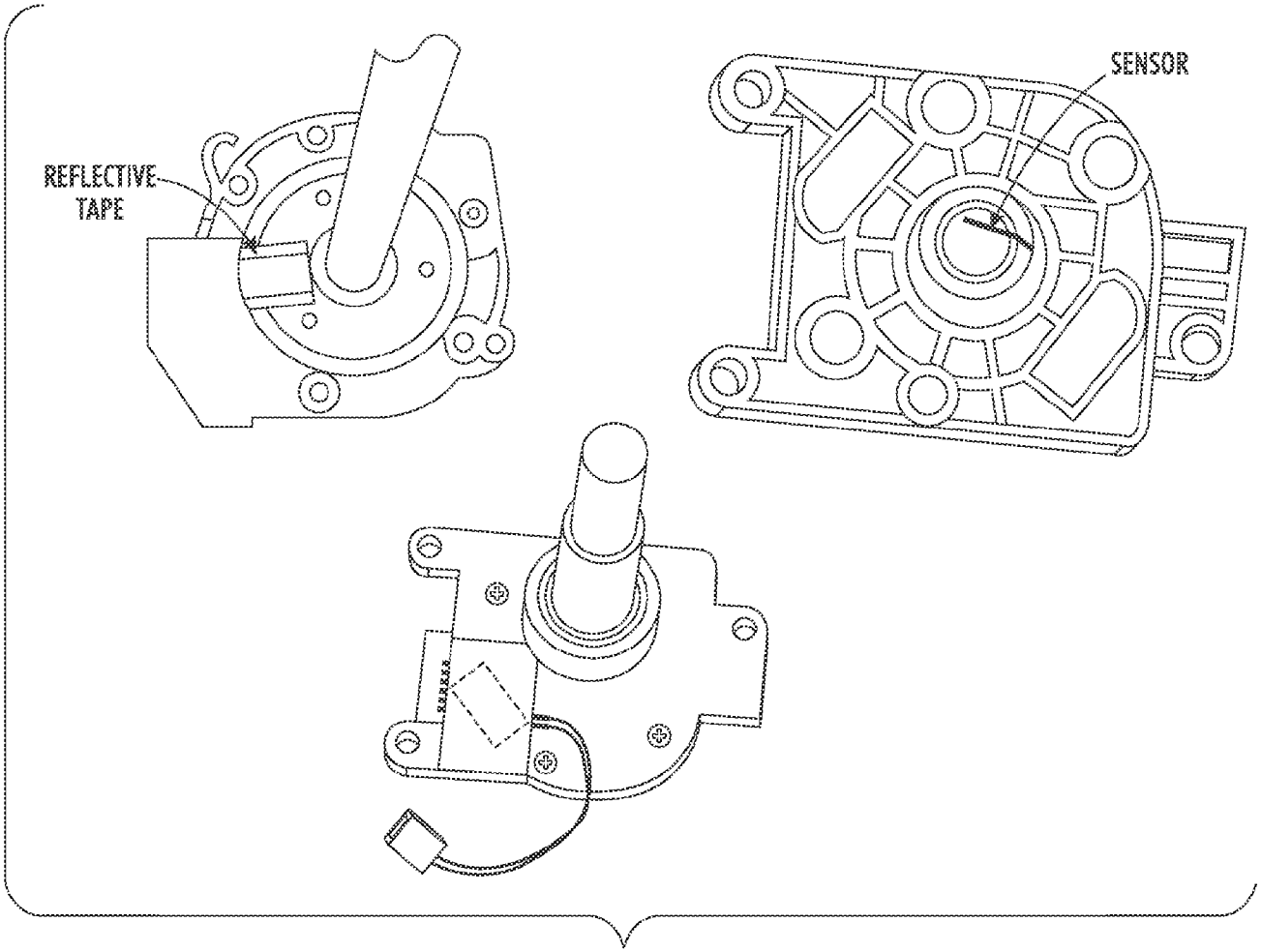
FIG. 11 provides several views of an exemplary 1× sensor on an exemplary marking module of an exemplary marking platform.

An example of a low cost 1× sensor is given in FIG. 11. An LED illuminator and a photodetector combined in a single package along with conditioning electronics is used as the sensor, and a strip of reflective tape is used to trigger the 1× sensor. In volume, this solution is expected to cost in the $1 range per sensor. A single sensor on a motor, along with known gear ratios should be sufficient for phase reference in a gear train. An example of a commercially-available 1× sensor is a photomicrosensor (reflective), part no. EE-SY125, from Omron Electronic Components LLC of Schaumburg, Ill.

To summarize, various exemplary embodiments of methods and systems for compensation of banding from multiple sources are provided herein. The system includes a set of 1× sensors installed on potential banding sources in the marking platform (e.g., printer). A calibration stage may be run periodically to obtain banding profiles for each banding source, determine dominant banding sources, and obtain banding signatures that are phase referenced to the low cost 1× sensors. During the correction stage, the banding signatures from the dominant sources and the respective low cost 1× sensor phase references are used to derive an exposure correction. Previous methods and systems have focused on single and fixed source banding while the method and system disclosed herein extend those concepts to multiple and variable source banding correction.

Figure 12:
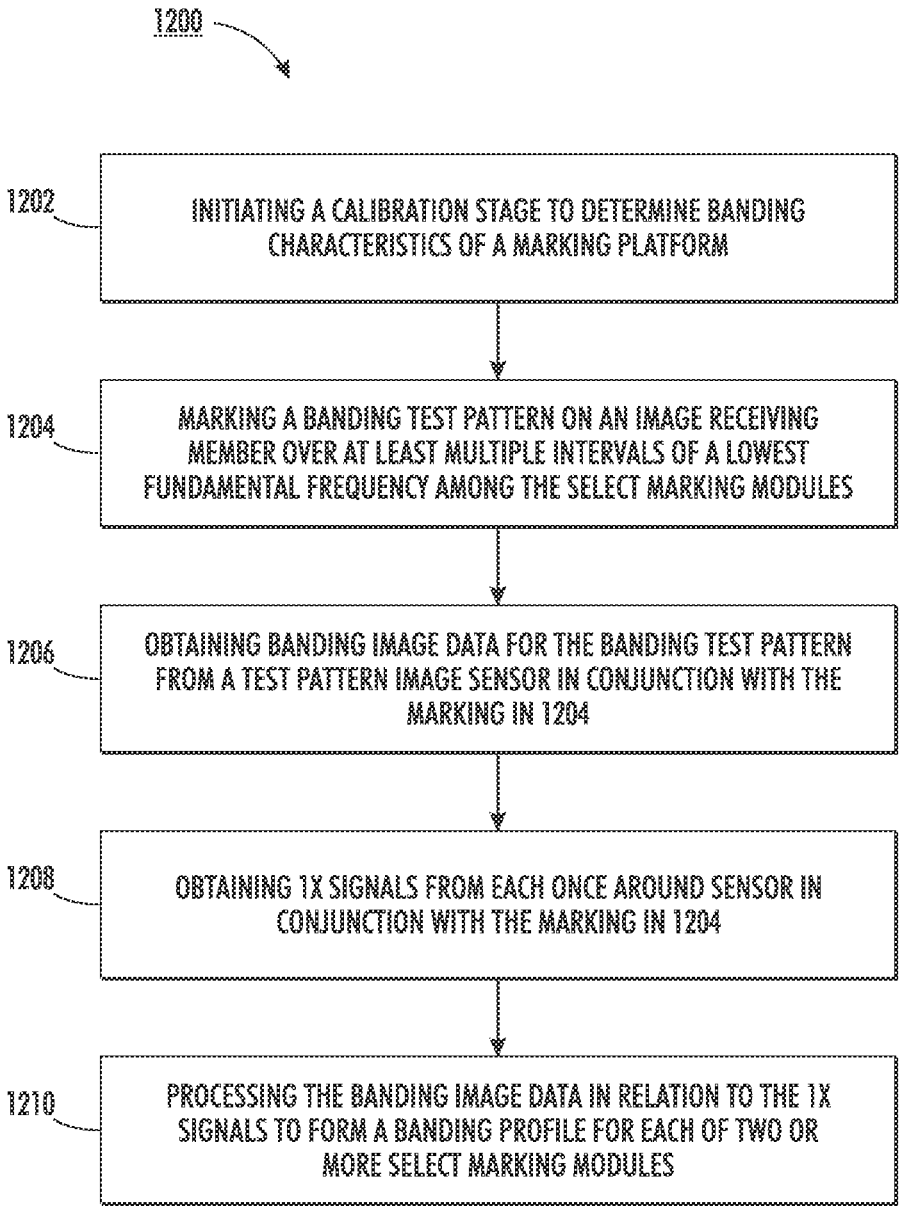
FIG. 12 is a flowchart showing an exemplary embodiment of a process for compensation of banding in a marking platform.

With reference to FIG. 12, an exemplary embodiment of a process 1200 for compensation of banding in a marking platform begins at 1202 where a calibration stage to determine banding characteristics of a marking platform may be initiated. The marking platform may include a plurality of marking modules at least a portion of which are select marking modules. Each select marking module may be provisioned with at least one once around (i.e., 1×) sensor. Each once around sensor may provide a 1× signal indicative of a fundamental frequency for banding characteristics associated with the corresponding select marking module.

Next, a banding test pattern may be marked on an image receiving member over at least multiple intervals of a lowest fundamental frequency among the fundamental frequencies associated with the select marking modules (1204). At 1206, banding image data for the banding test pattern may be obtained from a test pattern image sensor in conjunction with the marking in 1204. Next, 1× signals may be obtained from each once around sensor in conjunction with the marking in 1204 (1208). At 1210, the banding image data may be processed in relation to the 1× signals to form a banding profile for each of two or more select marking modules. The fundamental frequency associated with each 1× signal may be used to determine banding characteristics attributed to the corresponding select marking module and filter banding characteristics not attributed to the corresponding select marking module for the corresponding banding profile. Each banding profile may reflect a phase relation of amplitude banding characteristics to the corresponding fundamental frequency in relation to the banding test pattern.

In another embodiment, the process 1200 may also include obtaining a page synchronization signal associated with a process direction dimension for a select media size in conjunction with the marking in 1204. In this embodiment, the page synchronization signal may be used as a common reference to correlate the banding profiles to each other and to the corresponding 1× signals in conjunction with the processing in 1210.

In the embodiment being described, the image receiving member in 1204 may be a target media sheet in the select media size and the banding test pattern may be marked over a plurality of target media sheets. In this embodiment, the fundamental frequency associated with each 1× signal and the page synchronization signal may be used to arrange the banding image data from the plurality of target media sheets in time relation to construct the banding profiles for the select marking modules in conjunction with the processing in 1210.

In relation to the embodiment being described, a further embodiment of the process 1200 may include processing the banding image data in relation to the page synchronization signal to form an aperiodic banding profile for banding characteristics in the marking platform relating to page intervals. In this embodiment, the page synchronization signal may provide a reference signal indicative of a reference frequency relating to the page interval. In this further embodiment, the reference frequency for the page synchronization signal may be used to determine banding characteristics attributed to the one or more page intervals and filter banding characteristics not attributed to any page interval for the aperiodic banding profile. The aperiodic banding profile may reflect a phase relation of amplitude banding characteristics to the corresponding reference signal over multiple page intervals.

In various embodiments of the process 1200, the image data in 1206 may be obtained by an inline spectrophotometer, an inline FWA, an offline scanner, an offline spectrophotometer, or any suitable test pattern image sensor.

In yet another embodiment, the process 1200 may also include determining at least one amplitude value in two or more banding profiles from 1210 exceed a corresponding amplitude threshold to identify dominant banding profiles and corresponding dominant marking modules. In relation to the embodiment being described, a further embodiment of the process 1200 may include processing each dominant banding profile to form a dominant banding signature for the corresponding dominant marking module. Each dominant banding signature may reflect the phase relation of amplitude and frequency banding characteristics over at least one sample period of the corresponding fundamental frequency for the corresponding dominant marking module.

In relation to this further embodiment, another further embodiment of the process 1200 may include initiating a correction stage for banding compensation of the marking platform in conjunction with processing a marking job. In this further embodiment, 1× signals may be obtained from at least each once around sensor associated with the dominant marking modules in conjunction with processing the marking job. In the further embodiment being described, the dominant banding signatures and the 1× signals may be periodically processed to determine a current banding compensation value for the marking platform in conjunction with processing the marking job. In this further embodiment, the reference frequencies for the 1× signals may be used to combine the corresponding dominant banding signatures in elapsed time relation to a start time for processing the marking job to determine the current banding compensation value. In the further embodiment being described, the current banding compensation value may be processed using a predetermined actuator sensitivity value to determine a current banding correction value for a corresponding banding correction actuator such that a drive signal to the adjustable marking module may be adjusted by the corresponding banding correction value in conjunction with processing the marking job. In this further embodiment, the marking job may be processed using the banding correction value for the banding correction actuator.

In still another embodiment of the process 1200, the calibration stage may be initiated by an operator input, an elapsed time since last calibration stage, a quantity of prints since last calibration stage, a detection of a dominant banding source via regular banding characteristic monitoring, or any suitable means for initiating. In still yet another embodiment of the process 1200, when the dominant banding profile for the corresponding dominant marking module exceeds a second amplitude threshold, a service call is triggered to replace the corresponding dominant marking module.

Figure 13:
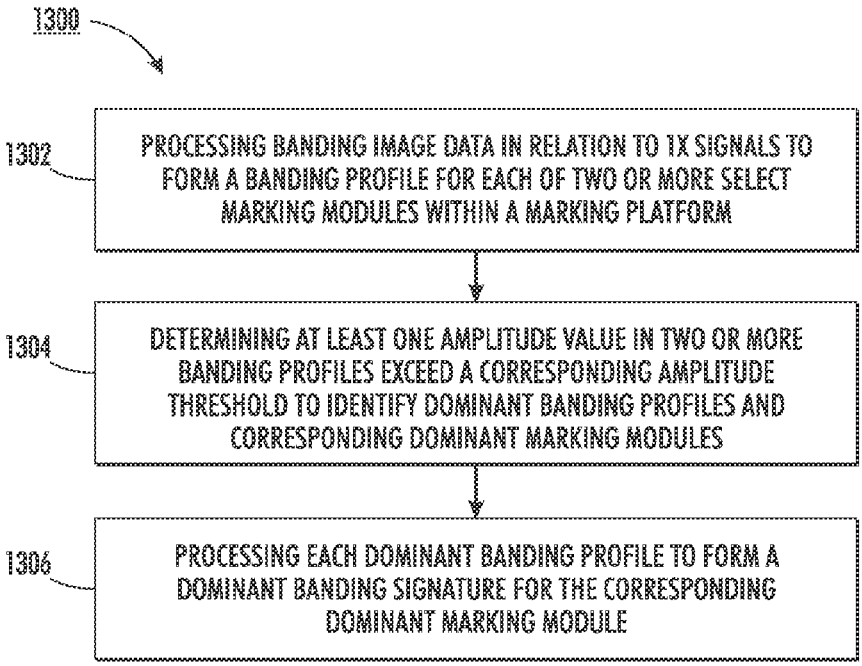
FIG. 13 is a flowchart showing another exemplary embodiment of a process for compensation of banding in a marking platform.

With reference to FIG. 13, another exemplary embodiment of a process 1300 for compensation of banding in a marking platform begins at 1302 where banding image data may be processed in relation to 1× signals to form a banding profile for each of two or more select marking modules within a marking platform. The marking platform may include a plurality of marking modules at least a portion of which are select marking modules. Each select marking module may be provided with at least one once around sensor. Each once around sensor may provide a 1× signal indicative of a fundamental frequency for banding characteristics associated with the corresponding select marking module.

Next, the process may determine that at least one amplitude value in two or more banding profiles exceed a corresponding amplitude threshold to identify dominant banding profiles and corresponding dominant marking modules (1304). At 1306, each dominant banding profile may be processed to form a dominant banding signature for the corresponding dominant marking module. Each dominant banding signature may reflect the phase relation of amplitude and frequency banding characteristics over at least one sample period of the corresponding fundamental frequency for the corresponding dominant marking module.

In another embodiment of the process 1300, the banding image data may be obtained from a test pattern image sensor and may be representative of a banding test pattern marked on an image receiving member over at least multiple intervals of a lowest fundamental frequency among the select marking modules. In yet another embodiment of the process 1300, the fundamental frequency associated with each 1× signal may be used to determine banding characteristics attributed to the corresponding select marking module and to filter banding characteristics not attributed to the corresponding select marking module for the corresponding banding profile. In this embodiment, each banding profile may reflect a phase relation of amplitude banding characteristics to the corresponding fundamental frequency in relation to the banding test pattern.

In still another embodiment, the process 1300 may also include obtaining a page synchronization signal associated with a process direction dimension for a select media size in conjunction with marking the banding test pattern on the image receiving member. In this embodiment, the page synchronization signal may be used as a common reference to correlate the banding profiles to each other and to the corresponding 1× signals in conjunction with the processing in 1302. In the embodiment being described, the image receiving member may be a target media sheet in the select media size and the banding test pattern may be marked over a plurality of target media sheets. In this embodiment, the fundamental frequency associated with each 1× signal and the page synchronization signal may be used to arrange the banding image data from the plurality of target media sheets in time relation to construct the banding profiles for the select marking modules in conjunction with the processing in 1302.

In still yet another embodiment, the process 1300 may also include initiating a correction stage for banding compensation of the marking platform in conjunction with processing a marking job. In this embodiment, 1× signals may be obtained from at least each once around sensor associated with the dominant marking modules identified in 1304 in conjunction with processing the marking job. In the embodiment being described, the dominant banding signatures formed in 1306 and the 1× signals may be periodically processed to determine a current banding compensation value for the marking platform in conjunction with processing the marking job. In this embodiment, the reference frequencies for the 1× signals may be used to combine the corresponding dominant banding signatures in elapsed time relation to a start time for processing the marking job to determine the current banding compensation value. In the embodiment being described, the current banding compensation value may be processed using a predetermined actuator sensitivity value to determine a current banding correction value for a corresponding banding correction actuator such that a drive signal to the banding correction actuator may be adjusted by the corresponding banding correction value in conjunction with processing the marking job. In this embodiment, the marking job may be processed using the current banding correction value for the banding correction actuator.

In another embodiment, the process 1300 may also include initiating a monitoring stage to check banding characteristics of the marking platform. In this embodiment, a banding monitoring pattern may be marked on an image receiving member over at least multiple intervals of a lowest fundamental frequency among the select marking modules. In the embodiment being described, monitor banding image data for the banding monitoring pattern may be obtained from a monitoring pattern image sensor in conjunction with the marking of the banding monitoring pattern. In this embodiment, the monitor banding image data may be processed to form a platform banding profile, the platform banding profile reflecting a phase relation of amplitude banding characteristics in relation to the banding monitoring pattern.

Figure 14:
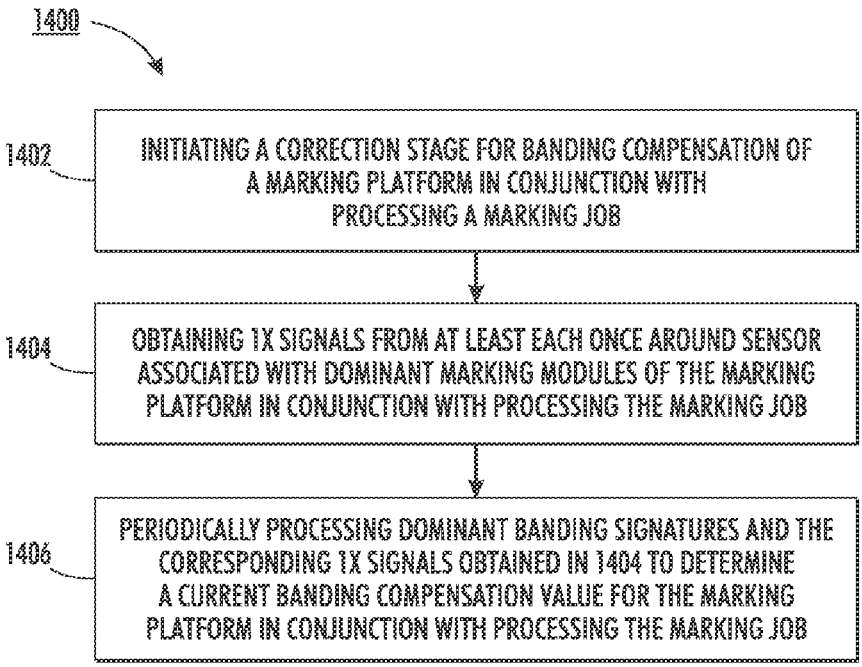
FIG. 14 is a flowchart showing yet another exemplary embodiment of a process for compensation of banding in a marking platform

With reference to FIG. 14, yet another exemplary embodiment of a process 1400 for compensation of banding in a marking platform begins at 1402 where a correction stage for banding compensation of a marking platform is initiated in conjunction with processing a marking job. The marking platform may include a plurality of marking modules at least a portion of which are select marking modules. Each select marking module may be provided with at least one once around sensor. Each once around sensor may be adapted to provide a 1× signal indicative of a fundamental frequency for banding characteristics associated with the corresponding select marking module.

Next, 1× signals may be obtained from at least each once around sensor associated with dominant marking modules of the marking platform in conjunction with processing the marking job (1404). The dominant marking modules may be identified as select marking modules in which at least one amplitude value in a banding profile for the corresponding select marking module exceeds a corresponding amplitude threshold. At 1406, dominant banding signatures and the corresponding 1× signals obtained in 1404 may be periodically processed to determine a current banding compensation value for the marking platform in conjunction with processing the marking job. Each dominant banding signature may be formed by processing the corresponding dominant banding profile for the corresponding dominant marking module. Each dominant banding signature may reflect the phase relation of amplitude and frequency banding characteristics over at least one sample period of the corresponding fundamental frequency for the corresponding dominant marking module. The reference frequencies for the 1× signals obtained in 1404 may be used to combine the corresponding dominant banding signatures in elapsed time relation to a start time for processing the marking job to determine the current banding compensation value.

In another embodiment, the process 1400 may also include processing the current banding compensation value formed in 1406 using a predetermined actuator sensitivity value to determine a current banding correction value for a corresponding banding correction actuator such that a drive signal to the banding correction actuator may be adjusted by the corresponding banding correction value in conjunction with processing the marking job. In relation to the embodiment being described, a further embodiment of the process 1400 may include processing the marking job using the current banding correction values for the banding correction actuator. In an alternate further embodiment, prior to the correction stage, the process 1400 may include determining the actuator sensitivity value by adjusting the drive signal to the banding correction actuator to a plurality of settings, measuring banding characteristics for the marking module associated with the banding correction actuator for each drive signal setting, and calculating the actuator sensitivity value in relation to the measured banding characteristics and the drive signals settings.

In yet another embodiment, the process 1400 may also include initiating a calibration stage prior to the correction stage to determine banding characteristics of the marking platform. In this embodiment, a banding test pattern may be marked on an image receiving member over at least multiple intervals of a lowest fundamental frequency among the select marking modules. In the embodiment being described, banding image data for the banding test pattern may be obtained from a test pattern image sensor in conjunction with the marking. In this embodiment, 1× signals may be obtained from each once around sensor in conjunction with the marking. In the embodiment being described, the banding image data may be processed in relation to the 1× signals to form the banding profile for each corresponding select marking module. In this embodiment, the fundamental frequency associated with each 1× signal may be used to determine banding characteristics attributed to the corresponding select marking module and filter banding characteristics not attributed to the corresponding select marking module for the corresponding banding profile, each banding signature reflecting a phase relation of amplitude banding characteristics to the corresponding fundamental frequency in relation to the banding test pattern.

In relation to the embodiment being described, a further embodiment of the process 1400 may include determining at least one amplitude value in two or more banding profiles exceed a corresponding amplitude threshold to identify the dominant banding profiles and the corresponding dominant marking modules. In this embodiment, each dominant banding profile may be processed to form the dominant banding signature for the corresponding dominant marking module. In relation to the embodiment being described, another yet further embodiment of the process 1400 may include obtaining a page synchronization signal associated with a process direction dimension for a select media size in conjunction with the marking. In this embodiment, the page synchronization signal may be used as a common reference to correlate the banding profiles to each other and to the corresponding 1× signals in conjunction with processing the banding image data. In the embodiment being described, the image receiving member may be a target media sheet in the select media size and the banding test pattern may be marked over a plurality of target media sheets. In this embodiment, the fundamental frequency associated with each 1× signal and the page synchronization signal may be used to arrange the banding image data from the plurality of target media sheets in time relation to construct the banding profiles for the select marking modules in conjunction with processing the banding image data.

Figure 15:
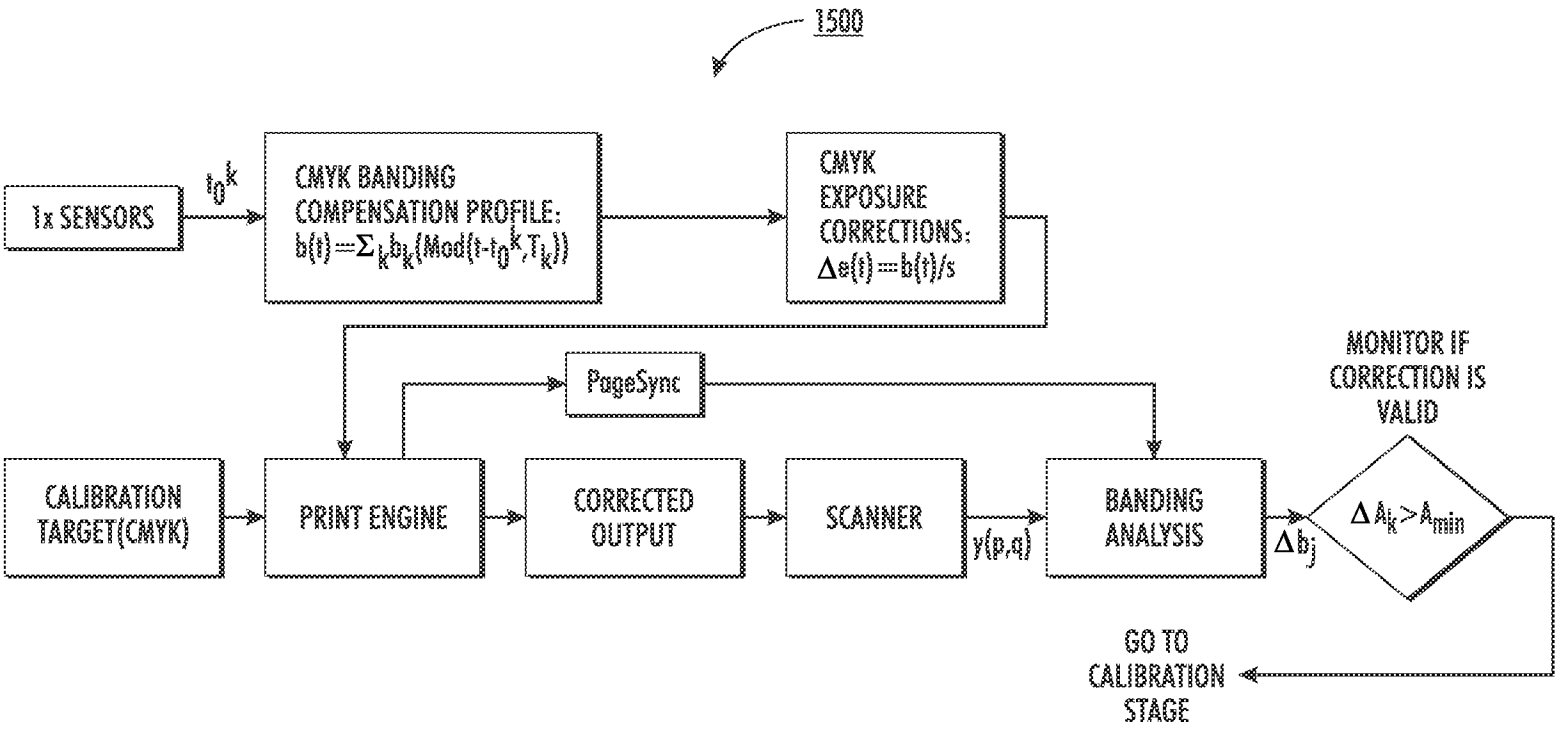
FIG. 15 is a block diagram of an exemplary embodiment of a monitoring stage of a banding compensation system for compensation of banding from multiple sources in an exemplary marking platform.

With reference to FIG. 15 in combination with FIG. 12, another exemplary embodiment of a process 1500 for compensation of banding in a marking platform includes initiating a monitoring stage to check banding characteristics of a marking platform, the marking platform comprising a plurality of marking modules at least a portion of which are select marking modules. Then, a banding monitoring pattern is marked on a monitoring image receiving member over at least multiple intervals of a lowest fundamental frequency among the select marking modules. In conjunction with this process 1500, the marking job is processed using the current banding correction values described above in relation to FIG. 14. Next, monitor banding image data is obtained for the banding monitoring pattern from a monitoring pattern image sensor in conjunction with the marking of the banding monitoring pattern.

In another embodiment, the process 1500 also includes obtaining 1× signals from at least each once around sensor associated with each select marking modules of the marking platform. In this embodiment, a page synchronization signal associated with a process direction dimension for a select media size is obtained in conjunction with the marking of the banding monitoring pattern. Then, the monitor banding image data, the corresponding 1× signals, and the page synchronization signal are processed to obtain a monitor banding profile for each select marking module.

In a further embodiment, the process also includes determining at least one amplitude value in the monitor banding profile exceeds a corresponding amplitude threshold to identify that banding is out of tolerance in the marking platform. In this embodiment, a calibration stage is initiated to determine banding characteristics of the marking platform as described above in relation to FIG. 12.

In various embodiments of the process 1500, the monitor stage is initiated by an operator input, an elapsed time since last monitor stage, a quantity of prints since last monitor stage, or any suitable initiation means.

Figure 16:
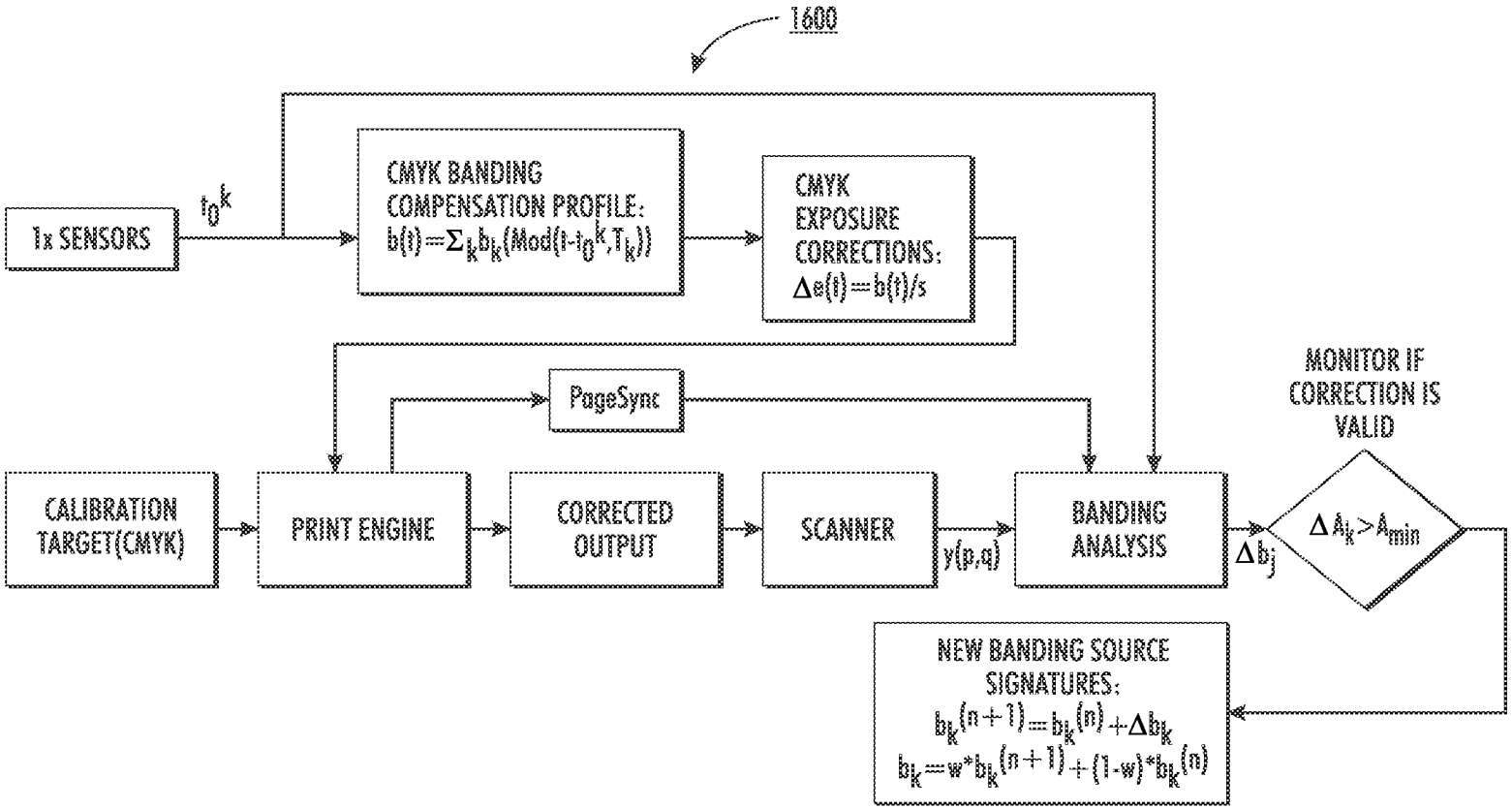
FIG. 16 is a block diagram of an exemplary embodiment of an iterative update stage of a banding compensation system for compensation of banding from multiple sources in an exemplary marking platform.

With reference to FIG. 16 in combination with FIG. 12, another exemplary embodiment of a process 1600 for compensation of banding in a marking platform includes initiating an iterative correction stage to update the banding signatures of a marking platform. In this embodiment, the marking platform includes a plurality of marking modules at least a portion of which are select marking modules. Next, the dominant monitor banding profiles described above in relation to FIG. 12 are determined. Then, each dominant monitor banding profile is processed to form a dominant monitor banding signature for the corresponding marking module. Each dominant monitor banding signature reflects the phase relation of amplitude and frequency banding characteristics over at least one sample period of the corresponding fundamental frequency for the corresponding dominant marking module. Next, the marking platform banding signatures are iteratively updated with the dominant monitor banding signatures.

Figure 17:
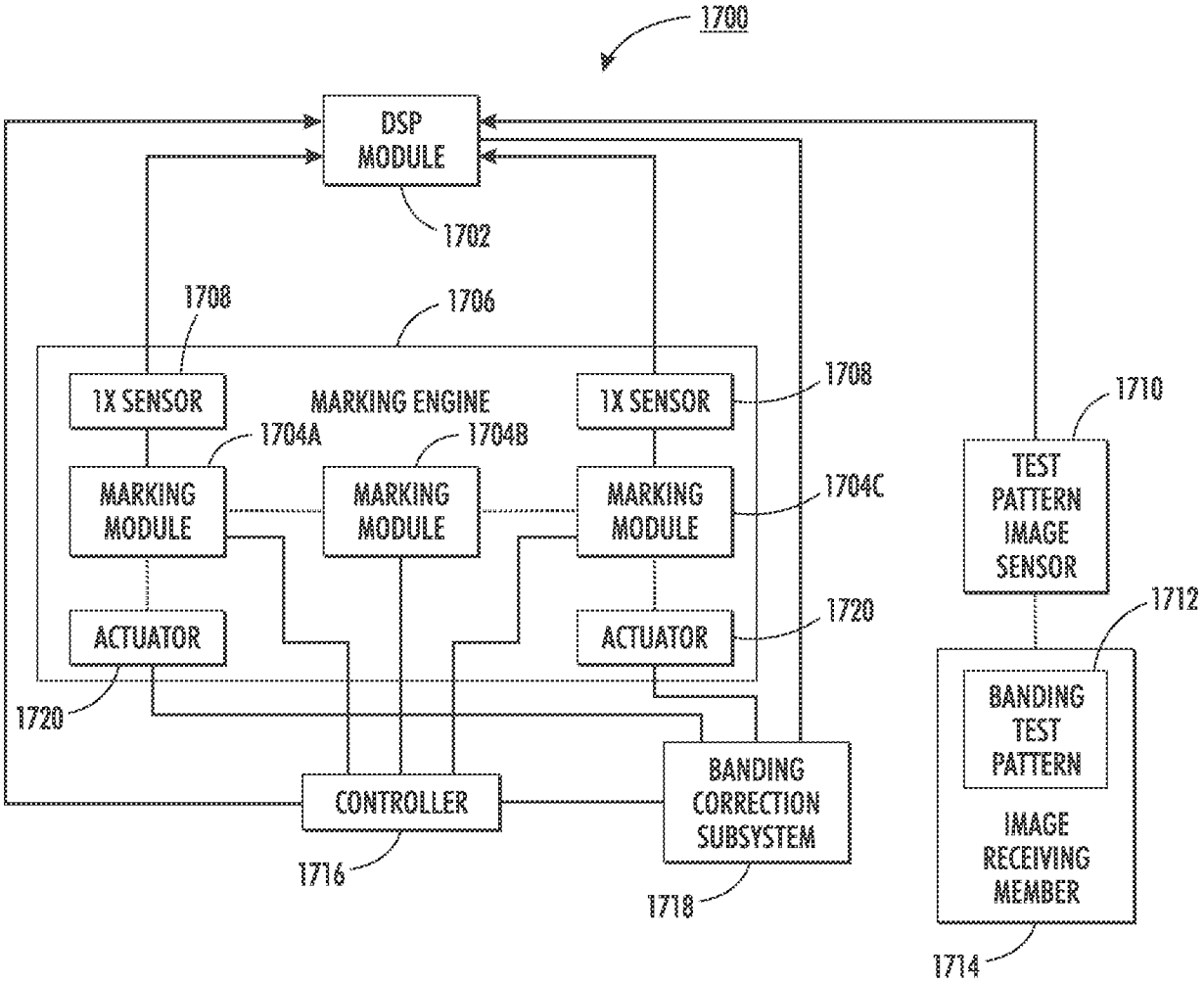
FIG. 17 is a block diagram of an exemplary embodiment of a marking platform that provides for compensation of banding from multiple sources.

With reference to FIG. 17 an exemplary embodiment of a marking platform 1700 that provides for compensation of banding includes a digital signal processing (DSP) modules 1702 for processing calibration banding image data in relation to 1× signals to form a banding profile for each of two or more select marking modules 1704*a,c* within a marking engine 1706. The marking engine 1706 including a plurality of marking modules 1704*a-c* at least a portion of which are select marking modules 1704*a,c*. Each select marking modules 1704*a,c* provided with at least one once around sensor 1708. Each once around sensor 1708 is adapted to provide a 1× signal indicative of a fundamental frequency for banding characteristics associated with the corresponding select marking modules 1704*a,c*. The calibration banding image data is obtained from a test pattern image sensor 1710 and representative of a banding test pattern 1712 marked on an image receiving member 1714 over at least multiple intervals of a lowest fundamental frequency among the select marking modules 1704*a,c*. The DSP modules 1702 is adapted to determine at least one amplitude value in two or more banding profiles exceed a corresponding amplitude threshold to identify dominant banding profiles and corresponding dominant marking modules. The DSP modules 1702 is also adapted to process each dominant banding profile to form a dominant banding signature for the corresponding dominant marking module. Each dominant banding signature reflects the phase relation of amplitude and frequency banding characteristics over at least one sample period of the corresponding fundamental frequency for the corresponding dominant marking module.

In another embodiment of the marking platform 1700, the fundamental frequency associated with each 1× signal is used to determine banding characteristics attributed to the corresponding select marking modules 1704*a,c* and filter banding characteristics not attributed to the corresponding select marking modules 1704*a,c* for the corresponding banding profile. Each banding profile reflects a phase relation of amplitude banding characteristics to the corresponding fundamental frequency in relation to the banding test pattern 1712.

In yet another embodiment, the marking platform also includes a marking engine controller 1716 for providing a page synchronization signal associated with a process direction dimension for a select media size to the DSP modules 1702 in conjunction with marking the banding test pattern 1712 on the image receiving member 1714. The page synchronization signal is used as a common reference to correlate the banding profiles to each other and to the corresponding 1× signals in conjunction with the processing of the calibration banding image data by the DSP modules 1702. In a further embodiment, the image receiving member 1714 is a target media sheet in the select media size and the banding test pattern 1712 is marked over a plurality of target media sheets. In this embodiment, the fundamental frequency associated with each 1× signal and the page synchronization signal are used to arrange the calibration banding image data from the plurality of target media sheets in time relation to construct the banding profiles for the select marking modules 1704*a,c* in conjunction with the processing of the calibration banding image data by the DSP modules 1702.

In still another embodiment, the marking platform 1700 also includes a marking engine controller 1716 and a banding correction subsystem 1718. In this embodiment, the marking engine controller 1716 is for initiating a correction stage for banding compensation of the marking platform 1700 in conjunction with processing a marking job. The banding correction subsystem 1718 is in operative communication with the DSP modules 1702 and the marking engine controller 1716. In the embodiment being described, the DSP modules 1702 is adapted to obtain 1× signals from at least each once around sensor 1708 associated with the dominant marking modules identified by the DSP modules 1702 in conjunction with processing the marking job. In this embodiment, the DSP modules 1702 is adapted to periodically process the dominant banding signatures formed in by the DSP module 1702 and the 1× signals obtained by the DSP modules 1702 to determine a current banding compensation value for the marking platform 1700 in conjunction with processing the marking job. In the embodiment being described, the reference frequencies for the 1× signals obtained by the DSP modules 1702 are used to combine the corresponding dominant banding signatures in elapsed time relation to a start time for processing the marking job to determine the current banding compensation value. In this embodiment, the banding correction subsystem 1718 is adapted to process the current banding compensation value formed by the DSP modules 1702 using a predetermined actuator sensitivity value to determine a current banding correction value for a corresponding banding correction actuator 1720 such that a drive signal to the banding correction actuator 1720 is adjusted by the corresponding banding correction value in conjunction with processing the marking job. In the embodiment being described, the marking engine controller 1716 is adapted to process the marking job using the current banding correction value determined by the banding correction subsystem 1718 for the banding correction actuator 1720.

In still yet another embodiment, the marking platform 1700 includes a marking engine controller 1716 for initiating a monitoring stage to check banding characteristics of the marking platform 1700. In this embodiment, the marking engine controller 1716 is adapted to control marking of a banding monitoring pattern on an image receiving member over at least multiple intervals of a lowest fundamental frequency among the select marking modules 1704*a,c*. In the embodiment being described, the DSP modules 1702 is adapted to obtain monitor banding image data for the banding monitoring pattern from a monitoring pattern image sensor in conjunction with the marking of the banding monitoring pattern. In this embodiment, the DSP modules 1702 is adapted to process the monitor banding image data to form a platform banding profile. In the embodiment being described, the platform banding profile reflects a phase relation of amplitude banding characteristics in relation to the banding monitoring pattern.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for compensation of banding in a marking platform, comprising:

a) obtaining banding image data for a banding test pattern from a test pattern image sensor, wherein the banding test pattern is indicative of banding characteristics of a marking platform, wherein each of at least two select marking modules in the marking platform are provisioned with at least one once around sensor adapted to provide a 1× signal indicative of a fundamental frequency for banding characteristics associated with the corresponding select marking module, wherein the banding test pattern is marked on an image receiving member by the marking platform over at least multiple intervals of a lowest fundamental frequency among the at least two select marking modules;

b) obtaining 1× signals from each once around sensor in relation to the marking of the banding test pattern on the image receiving member; and c) processing the banding image data in relation to the 1× signals to form a banding profile for each of the at least two select marking modules.

2. The method set forth in claim 1 wherein the fundamental frequency associated with each 1× signal is used to determine banding characteristics attributed to the corresponding select marking module and filter banding characteristics not attributed to the corresponding select marking module for the corresponding banding profile.

3. The method set forth in claim 1 wherein each banding profile reflects a phase relation of amplitude banding characteristics to the corresponding fundamental frequency in relation to the banding test pattern.

4. The method set forth in claim 1, further comprising:

d) obtaining a page synchronization signal associated with a process direction dimension for a select media size in conjunction with the marking of the banding test pattern, wherein the page synchronization signal is used as a common reference to correlate the banding profiles to each other and to the corresponding 1× signals in conjunction with the processing of the banding image data.

5. The method set forth in claim 4 wherein the image receiving member is a target media sheet in the select media size and the banding test pattern is marked over a plurality of target media sheets, wherein the fundamental frequency associated with each 1× signal and the page synchronization signal are used to arrange the banding image data from the plurality of target media sheets in time relation to construct the banding profiles for the select marking modules in conjunction with the processing of the banding image data.

6. The method set forth in claim 4, further comprising:

e) processing the banding image data in relation to the page synchronization signal to form an aperiodic banding profile for banding characteristics in the marking platform relating to page intervals, wherein the page synchronization signal is adapted to provide a reference signal indicative of a reference frequency relating to the page interval, wherein the reference frequency for the page synchronization signal is used to determine banding characteristics attributed to the one or more page intervals and filter banding characteristics not attributed to any page interval for the aperiodic banding profile, wherein the aperiodic banding profile reflects a phase relation of amplitude banding characteristics to the corresponding reference signal over multiple page intervals.

7. The method set forth in claim 1, further comprising:

d) determining at least one amplitude value in each of two or more of the banding profiles formed by processing the banding image data exceed a corresponding amplitude threshold to identify two or more dominant banding profiles and corresponding dominant marking modules; and e) processing each dominant banding profile to form a dominant banding signature for the corresponding dominant marking module, each dominant banding signature reflecting the phase relation of amplitude and frequency banding characteristics over at least one sample period of the corresponding fundamental frequency for the corresponding dominant marking module.

8. The method set forth in claim 7, further comprising:

f) initiating an iterative correction stage to update the banding signatures of the marking platform;

g) periodically repeating a) through d) to identify dominant banding profiles and corresponding current dominant marking modules for the marking platform; and h) processing the dominant banding profiles to form corresponding dominant banding signatures for the dominant marking modules to iteratively update the dominant banding signatures of the marking platform.

9. A method for compensation of banding in a marking platform, comprising:

a) obtaining a 1× signal from each once around sensor associated with each dominant marking module of a marking platform in conjunction with processing a marking job, wherein the marking platform includes a plurality of marking modules, at least a portion of which are select marking modules, wherein each select marking module is provisioned with at least one once around sensor, wherein each once around sensor is adapted to provide a 1× signal indicative of a fundamental frequency for banding characteristics associated with the corresponding select marking module, wherein each select marking module with at least one amplitude value in a banding profile for the corresponding select marking module that exceeds a corresponding amplitude threshold is a dominant marking module; and b) periodically processing banding signatures for the dominant marking modules and the corresponding 1× signals to determine a current banding compensation value for the marking platform in conjunction with processing the marking job, wherein each dominant banding signature is formed by processing the corresponding dominant banding profile for the corresponding dominant marking module.

10. The method set forth in claim 9 wherein each dominant banding signature reflects a phase relation of amplitude and frequency banding characteristics over at least one sample period of the corresponding fundamental frequency for the corresponding dominant marking module.

11. The method set forth in claim 9 wherein reference frequencies for the 1× signals obtained from dominant marking modules are used to combine the corresponding dominant banding signatures in elapsed time relation to a start time for processing the marking job to determine the current banding compensation value.

12. The method set forth in claim 9, further comprising:

c) processing the current banding compensation value using a predetermined actuator sensitivity value to determine a current banding correction value for a corresponding banding correction actuator such that a drive signal to the banding correction actuator is adjusted by the corresponding banding correction value in conjunction with processing the marking job.

13. The method set forth in claim 12, further comprising:

d) determining the actuator sensitivity value by adjusting the drive signal to the banding correction actuator to a plurality of signal settings, measuring banding characteristics for the marking module associated with the banding correction actuator for each signal setting, and calculating the actuator sensitivity value in relation to the measured banding characteristics and the signals settings.

14. The method set forth in claim 12, further comprising:

d) processing the marking job using the current banding correction value for the banding correction actuator.

15. The method set forth in claim 10, further comprising:

c) initiating a monitoring stage to check banding characteristics of the marking platform;

d) marking a banding monitoring pattern on a monitoring image receiving member using the marking platform over at least multiple intervals of a lowest fundamental frequency among the select marking modules, wherein the banding monitoring pattern is indicative of banding characteristics of the marking platform;

e) obtaining monitor banding image data for the banding monitoring pattern from a monitoring pattern image sensor in conjunction with the marking;

f) obtaining 1× signals from each once around sensor in relation to the marking of the banding monitoring pattern on the monitoring image receiving member;

g) obtaining a page synchronization signal associated with a process direction dimension for a select media size in relation to the marking of the banding monitoring pattern on the monitoring image receiving member; and h) processing the monitor banding image data, the corresponding 1× signals, and the page synchronization signal to obtain a monitor banding profile for each select marking module.

16. The method set forth in claim 15, further comprising:

i) determining at least one amplitude value in the monitor banding profile exceeds a corresponding amplitude threshold to identify that banding is out of tolerance in the marking platform; and j) initiating a calibration stage to determine banding characteristics of the marking platform.

17. An apparatus for compensation of banding in a marking platform, comprising:

a digital signal processing module for processing calibration banding image data in relation to 1× signals to form a banding profile for each of two or more select marking modules within a marking platform;

wherein the marking platform includes a plurality of marking modules at least a portion of which are select marking modules;

wherein each select marking module is provisioned with at least one once around sensor adapted to provide a 1× signal indicative of a fundamental frequency for banding characteristics associated with the corresponding select marking module;

wherein the calibration banding image data is obtained from a test pattern image sensor and representative of a banding test pattern marked on an image receiving member by the marking platform over at least multiple intervals of a lowest fundamental frequency among the two or more select marking modules.

18. The apparatus set forth in claim 17 wherein the digital signal processing module is adapted to determine at least one amplitude value in two or more banding profiles exceed a corresponding amplitude threshold to identify dominant banding profiles and corresponding dominant marking modules;

wherein the digital signal processing module is adapted to process each dominant banding profile to form a dominant banding signature for the corresponding dominant marking module, wherein each dominant banding signature reflects a phase relation of amplitude and frequency banding characteristics over at least one sample period of the corresponding fundamental frequency for the corresponding dominant marking module.

19. The apparatus set forth in claim 17, further comprising:

a marking engine controller for providing a page synchronization signal associated with a process direction dimension for a select media size to the digital signal processing module in conjunction with marking the banding test pattern on the image receiving member, wherein the page synchronization signal is used as a common reference to correlate the banding profiles to each other and to the corresponding 1× signals in conjunction with the processing of the calibration banding image data by the digital signal processing module;

wherein the image receiving member is a target media sheet in the select media size and the banding test pattern is marked over a plurality of target media sheets, wherein the fundamental frequency associated with each 1× signal and the page synchronization signal are used to arrange the calibration banding image data from the plurality of target media sheets in time relation to construct the banding profiles for the select marking modules in conjunction with the processing of the calibration banding image data by the digital signal processing module.

20. The apparatus set forth in claim 17, further comprising:

a marking engine controller for initiating a correction stage for banding compensation of the marking platform in conjunction with processing a marking job; and a banding correction subsystem in operative communication with the digital signal processing module and the marking engine controller;

wherein the digital signal processing module is adapted to obtain 1× signals from at least each once around sensor associated with the dominant marking modules identified by the digital signal processing module in conjunction with processing the marking job;

wherein the digital signal processing module is adapted to periodically process the dominant banding signatures formed in by the digital signal processing module and the 1× signals obtained by the digital signal processing module to determine a current banding compensation value for the marking platform in conjunction with processing the marking job, wherein the reference frequencies for the 1× signals obtained by the digital signal processing module are used to combine the corresponding dominant banding signatures in elapsed time relation to a start time for processing the marking job to determine the current banding compensation value;

wherein the banding correction subsystem is adapted to process the current banding compensation value formed by the digital signal processing module using a predetermined actuator sensitivity value to determine a current banding correction value for a corresponding banding correction actuator such that a drive signal to the banding correction actuator is adjusted by the corresponding banding correction value in conjunction with processing the marking job;

wherein the marking engine controller is adapted to process the marking job using the current banding correction value determined by the banding correction subsystem for the banding correction actuator.

21. The apparatus set forth in claim 17, further comprising:

a marking engine controller for initiating a monitoring stage to check banding characteristics of the marking platform;

wherein the marking engine controller is adapted to control marking of a banding monitoring pattern on an image receiving member over at least multiple intervals of a lowest fundamental frequency among the select marking modules;

wherein the digital signal processing module is adapted to obtain monitor banding image data for the banding monitoring pattern from a monitoring pattern image sensor in conjunction with the marking of the banding monitoring pattern; and wherein the digital signal processing module is adapted to process the monitor banding image data to form a platform banding profile, the platform banding profile reflecting a phase relation of amplitude banding characteristics in relation to the banding monitoring pattern.

* * * * *